US011465172B2

(12) United States Patent
Meyers et al.

(10) Patent No.: US 11,465,172 B2
(45) Date of Patent: Oct. 11, 2022

(54) METHOD AND APPARATUS FOR COATING ON BAGGY WEB

(71) Applicant: 3M INNOVATIVE PROPERTIES COMPANY, St. Paul, MN (US)

(72) Inventors: Kara A. Meyers, Oakdale, MN (US); Shawn C. Dodds, St. Paul, MN (US); Eric A. Vandre, Roseville, MN (US); Tyler J. Rattray, Minneapolis, MN (US); Kevin T. Grove, Hammond, WI (US); Brittni M. Schiewer, St. Paul, MN (US); Mikhail L. Pekurovsky, Bloomington, MN (US); Samad Javid, Woodbury, MN (US); James N. Dobbs, Woodbury, MN (US); Wayne D. Meredyk, Maplewood, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 196 days.

(21) Appl. No.: 16/763,152

(22) PCT Filed: Nov. 12, 2018

(86) PCT No.: PCT/IB2018/058872
§ 371 (c)(1),
(2) Date: May 11, 2020

(87) PCT Pub. No.: WO2019/102295
PCT Pub. Date: May 31, 2019

(65) Prior Publication Data

US 2020/0306790 A1 Oct. 1, 2020

Related U.S. Application Data

(60) Provisional application No. 62/589,249, filed on Nov. 21, 2017.

(51) Int. Cl.
*B05D 1/28* (2006.01)
*B05C 1/08* (2006.01)
(Continued)

(52) U.S. Cl.
CPC ..... *B05D 1/28* (2013.01); *B05C 1/083* (2013.01); *B05C 1/0808* (2013.01);
(Continued)

(58) Field of Classification Search
CPC ..... B05D 1/28; D21H 25/12; D21H 23/56; D21H 23/58; B05C 1/083; B05C 1/0865; B05C 1/12; B05C 1/0808; B05C 11/044
(Continued)

(56) References Cited

U.S. PATENT DOCUMENTS 2,946,307 A 7/1960 Warner
3,701,335 A 10/1972 Barnscheidt
(Continued)

FOREIGN PATENT DOCUMENTS

GB 1347107 2/1974
JP H11-207225 3/1999
(Continued)

OTHER PUBLICATIONS

Good, "Modeling Rubber Covered Nip Rollers in Web Lines", Proceedings of the Sixth International Conference on Web Handling, Oklahoma State University, 2001, 28 pages.
(Continued)

*Primary Examiner* — Laura Edwards
(74) *Attorney, Agent, or Firm* — Thomas M. Spielbauer

(57) ABSTRACT

Methods and apparatuses for applying coatings on a baggy web are provided. A Mayer rod and a back-up roll engage with each other to form a nip. The back-up roll has a deformable inner layer with a surface thereof covered by a deformable outer layer. The Mayer rod and the flexible web
(Continued)

at a contacting area are impressed into the back-up roll with a machine-direction nip width W and a nip engagement depth D, which enables formation of a coating having a substantially uniform thickness.

20 Claims, 13 Drawing Sheets

(51) Int. Cl.

| | |
|---|---|
| ***B05C 1/12*** | (2006.01) |
| ***B05C 11/04*** | (2006.01) |
| ***D21H 23/56*** | (2006.01) |
| ***D21H 23/58*** | (2006.01) |
| ***D21H 25/12*** | (2006.01) |

(52) U.S. Cl.
CPC ..... *B05C 1/0865* (2013.01); *B05C 1/12* (2013.01); *B05C 11/044* (2013.01); *D21H 23/56* (2013.01); *D21H 23/58* (2013.01); *D21H 25/12* (2013.01)

(58) Field of Classification Search
USPC ..... 427/428.21; 118/249
See application file for complete search history.

(56) References Cited

U.S. PATENT DOCUMENTS

| | | | | |
|---|---|---|---|---|
| 5,206,992 | A | 5/1993 | Carlson | |
| 6,079,352 | A | 6/2000 | Principe | |
| 6,110,320 | A * | 8/2000 | Principe | B05C 11/025 156/289 |
| 6,178,657 | B1 | 1/2001 | Graff | |
| 6,589,596 | B2 | 7/2003 | Takekuma | |

FOREIGN PATENT DOCUMENTS

| | | |
|---|---|---|
| JP | 2000-107661 | 4/2000 |
| JP | 2009-178660 | 8/2009 |
| WO | WO 2016-200866 | 12/2016 |

OTHER PUBLICATIONS

Johnson, Contact Mechanics—Cambridge University Press, (1985) 8 pages.
Young, Roark's Formulas for Stress and Strain Seventh Edition, (2002) 7 pages.
International Search Report for PCT International Application No. PCT/IB2018/058872, dated Feb. 28, 2019, 5 pages.

* cited by examiner

METHOD AND APPARATUS FOR COATING ON BAGGY WEB

CROSS REFERENCE TO RELATED APPLICATIONS

This application is a national stage filing under 35 U.S.C. 371 of PCT/IB2018/058872, filed Nov. 12, 2018, which claims the benefit of U.S. application Ser. No. 62/589,249, filed Nov. 21, 2017, the disclosure of which is incorporated by reference in its/their entirety herein.

TECHNICAL FIELD

The present disclosure relates to methods and apparatus of applying a uniform coating on a baggy web via a Mayer rod over a back-up roll.

BACKGROUND

The use of a wire-wound rod, called a Mayer or Meyer rod, as a coating and/or metering device for applying coating on a web is well known. FIG. 1' illustrates a Mayer rod 2' for coating a material 7' on a free span 3' of a flexible web.

SUMMARY

There is a desire to improve coating uniformity when applying a coating on a baggy web via a Mayer rod. For example, in the process shown in FIG. 1', the free span 3' of a baggy web may not evenly contact the Mayer rod 2', leading to variations in coat weight/thickness across the baggy web. The present disclosure provides methods and apparatuses of applying a uniform coating on a baggy web via a Mayer rod over a back-up roll. The methods and apparatuses described herein allow a baggy web to be spread evenly over the face of the back-up roll, forming a non-baggy surface when going through the coating nip and enabling an even coating on the baggy web.

Briefly, in one aspect, the disclosure describes a method including providing a back-up roll having a deformable inner layer with a surface thereof covered by a deformable outer layer. The inner layer is softer than the outer layer. A Mayer rod is provided in contact with the back-up roll; disposing a flexible web between the back-up roll and the Mayer rod. The flexible web wraps around at least one of the back-up roll and the Mayer rod. The Mayer rod and the back-up roll are pressed against each other to form a nip therebetween. The Mayer rod and the flexible web at a contacting area are impressed into the back-up roll with a machine-direction nip width W and a nip engagement depth D. The method further includes providing a coating material upstream of the nip to form a coating on a surface of the web downstream of the nip. The back-up roll has an S-Factor, averaged over a range of the nip engagement D from about 0.05 mm to about 1 mm, optionally being less than about 15 ($10^6 \cdot N/m^{5/2}$), or less than about 10 ($10^6 \cdot N/m^{5/2}$). The coating can have a substantially uniform thickness across the surface of the web. In some embodiments, the method further includes adjusting at least one of the nip width W and the engagement depth D to adjust a wet thickness of the coating. The machine-direction nip width W or the nip engagement depth D can be adjusted by adjusting the relative distance between the respective axes of the Mayer rod and the back-up roll.

In another aspect, this disclosure describes a coating apparatus including a back-up roll having a deformable inner layer with a surface thereof covered by a deformable outer layer. The inner layer is softer than the outer layer. A Mayer rod is in contact with the back-up roll. A flexible web is disposed between the back-up roll and the Mayer rod, wrapping around at least one of the back-up roll and the Mayer rod. One or more mechanical holders are configured to press the Mayer rod and the back-up roll against each other to form a nip therebetween. The Mayer rod and the flexible web at a contacting area are impressed into the back-up roll with a machine-direction nip width W and a nip engagement depth D. The back-up roll has an S-Factor, averaged over a range of the nip engagement D from about 0.05 mm to about 1 mm, optionally being less than about 15 ($10^6 \cdot N/m^{5/2}$), or less than about 10 ($10^6 \cdot N/m^{5/2}$). In some embodiments, a positioning mechanism is provided to control the distance between the respective axes of the Mayer rod and the back-up roll so as to adjust at least one of the nip width W and the engagement depth D.

Various unexpected results and advantages are obtained in exemplary embodiments of the disclosure. One such advantage of exemplary embodiments of the present disclosure is that a substantially uniform coating can be formed on a baggy web via a Mayer rod over a back-up roll. This can be achieved by creating a nip, via the engagement of the Mayer rod and the back-up roll, where the Mayer rod, the flexible web and the deformable outer layer at a contacting area are impressed into the deformable inner layer with a certain engagement width and depth. The embodiments described herein can significantly mitigate undesired effects of the baggy web on coating uniformity. In contrast, coating on a free-span of a baggy web may result in variations in coat weight across the web, while coating against a typical, more rigid backup roll, may create issues related to back-up roll nonuniformity.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF THE DRAWINGS

The disclosure may be more completely understood in consideration of the following detailed description of various embodiments of the disclosure in connection with the accompanying drawings, in which.

Figure 1:
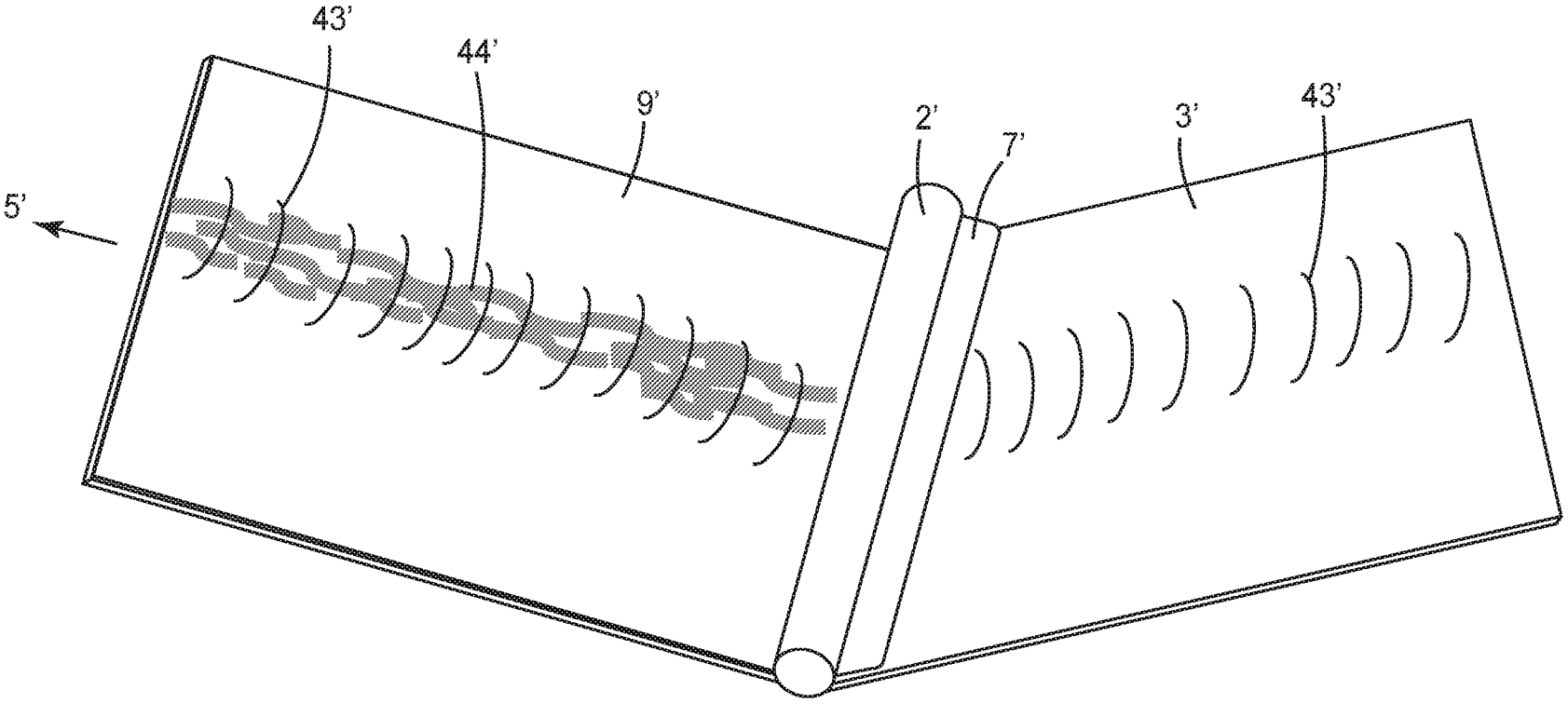
FIG. 1' Prior Art
FIG. 1' illustrates a perspective view of a Mayer rod coating on a free-span web (prior art).
Figure 1A:
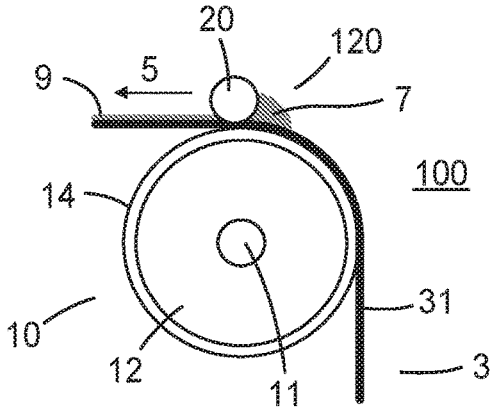
FIG. 1A is a perspective view of a coating apparatus applying coating on a baggy web, according to one embodiment.
Figure 1B:
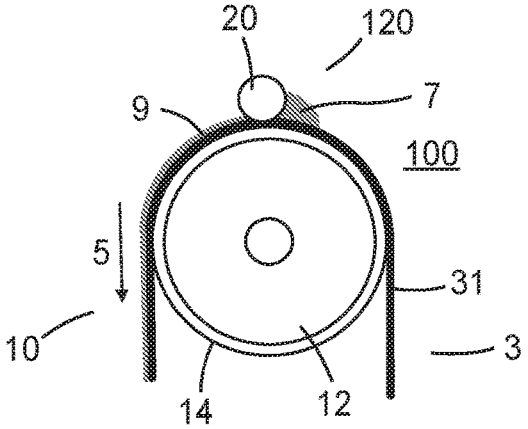
FIG. 1B is a perspective view of a coating apparatus applying coating on a baggy web, according to another embodiment.
Figure 1C:
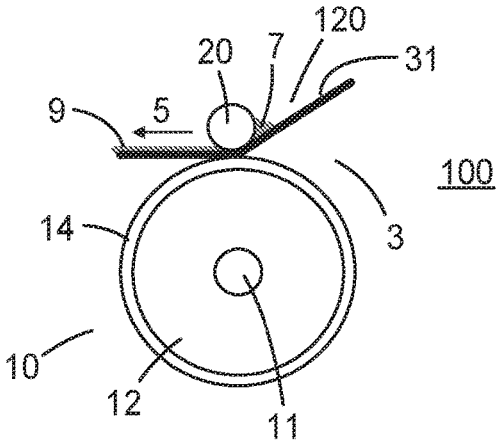
FIG. 1C is a perspective view of a coating apparatus applying coating on a baggy web, according to another embodiment.
Figure 1D:
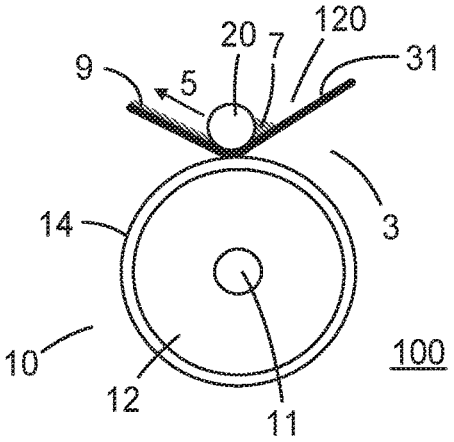
FIG. 1D is a perspective view of a coating apparatus applying coating on a baggy web, according to another embodiment.

In the drawings, like reference numerals indicate like elements. While the above-identified drawings, which may not be drawn to scale, sets forth various embodiments of the present disclosure, other embodiments are also contemplated, as noted in the Detailed Description. In all cases, this disclosure describes the presently disclosed disclosure by way of representation of exemplary embodiments and not by express limitations. It should be understood that numerous other modifications and embodiments can be devised by those skilled in the art, which fall within the scope and spirit of this disclosure.

DETAILED DESCRIPTION

For the following Glossary of defined terms, these definitions shall be applied for the entire application, unless a different definition is provided in the claims or elsewhere in the specification.

Glossary

Certain terms are used throughout the description and the claims that, while for the most part are well known, may require some explanation. It should be understood that:

In this application, the terms "compressible" or "incompressible" refers to a material property, i.e., compressibility, of an object (e.g., an elastomer outer layer) which is a measure of the relative volume change of the material in response to a pressure. For example, the term "substantially incompressible" refers to a material having a Poisson's ratio greater than about 0.45.

The term "elastically deformable" means a deformed object (e.g., an inner layer of synthetic foam) being capable of substantially 100% (e.g., 99% or more, 99.5% or more, or 99.9% or more) recovering to its original state.

In this application, the term "nip" refers to a system of either a Mayer rod and a back-up roll, or a Mayer rod, a back-up roll, and a flexible web, with an impression therebetween when the distance between the center of the Mayer rod and the back-up roll is less than the sum of the radii of the two rolls and the thickness of the web and coating thereon when the web and the coating material are present. Additionally, within a nip region a back-up roll and a flexible web may both substantially conform to a contacting surface of a Mayer rod over a nip width W in the machine direction.

The term "baggy web" refers to a web that shows non-planarity or distortions, at least in a portion of the surface of the web, when positioned on a flat surface. The web bagginess, which may be caused by differential tensions across the width of the web during the web manufacturing, can result in cross-web direction (CD) length variation. U.S. Pat. No. 6,178,657 describes a method and apparatus to measure the internal web length differences in the CD of sheet materials. In this application, the CD length variation of a baggy web can be equivalent to or smaller than, for example, 10,000 ppm (equivalent to 1% strain), or 1,000 ppm (equivalent to 0.1% strain).

In this application, the terms "polymer" or "polymers" includes homopolymers and copolymers, as well as homopolymers or copolymers that may be formed in a miscible blend, e.g., by coextrusion or by reaction, including, e.g., transesterification. The term "copolymer" includes random, block and star (e.g. dendritic) copolymers.

In this application, by using terms of orientation such as "atop", "on", "over," "covering", "uppermost", "underlying" and the like for the location of various elements in the disclosed coated articles, we refer to the relative position of an element with respect to a horizontally-disposed, upwardly-facing substrate (e.g., web). However, unless otherwise indicated, it is not intended that the substrate (e.g., web) or articles should have any particular orientation in space during or after manufacture.

In this application, by using the term "overcoated" to describe the position of a layer with respect to a substrate (e.g., web) or other element of an article of the present disclosure, we refer to the layer as being atop the substrate (e.g., web) or other element, but not necessarily contiguous to either the substrate (e.g., web) or the other element.

In this application, the term "machine direction" refers to the direction in which the web travels. Similarly, the term cross-web refers to the direction perpendicular to the machine direction (i.e. perpendicular to the direction of travel for the web).

In this application, the terms "about" or "approximately" with reference to a numerical value or a shape means+/−five percent of the numerical value or property or characteristic, but expressly includes the exact numerical value. For example, a viscosity of "about" 1 Pa-sec refers to a viscosity from 0.95 to 1.05 Pa-sec, but also expressly includes a viscosity of exactly 1 Pa-sec. Similarly, a perimeter that is "substantially square" is intended to describe a geometric shape having four lateral edges in which each lateral edge has a length which is from 95% to 105% of the length of any other lateral edge, but which also includes a geometric shape in which each lateral edge has exactly the same length.

In this application, the term "substantially" with reference to a property or characteristic means that the property or characteristic is exhibited to a greater extent than the opposite of that property or characteristic is exhibited. For example, a substrate (e.g., web) that is "substantially" transparent refers to a substrate (e.g., web) that transmits more radiation (e.g. visible light) than it fails to transmit (e.g. absorbs and reflects). Thus, a substrate (e.g., web) that transmits more than 50% of the visible light incident upon its surface is substantially transparent, but a substrate (e.g., web) that transmits 50% or less of the visible light incident upon its surface is not substantially transparent.

In this application, the singular forms "a", "an", and "the" include plural referents unless the content clearly dictates otherwise. Thus, for example, reference to fine fibers containing "a compound" includes a mixture of two or more compounds. As used in this specification and the appended embodiments, the term "or" is generally employed in its sense including "and/or" unless the content clearly dictates otherwise.

As used in this application, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the specification and more particularly the Listing of Exemplary Embodiments and the claims can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Exemplary embodiments of the present disclosure may take on various modifications and alterations without departing from the spirit and scope of the present disclosure. Accordingly, it is to be understood that the embodiments of the present disclosure are not to be limited to the following described exemplary embodiments, but are to be controlled by the limitations set forth in the claims and any equivalents thereof.

Methods and apparatuses are described herein for Mayer rod coating on a baggy substrate. In a coating process described herein, a flexible web is disposed between a back-up roll and a Mayer rod. The back-up roll has a deformable inner layer with a surface thereof covered by a deformable outer layer. The inner layer may be softer than the outer layer. The flexible web can be a baggy web that wraps around the back-up roll, the Mayer rod, or both. The Mayer rod is pressed against the flexible web and the back-up roll to form a nip therebetween, where the Mayer rod, the flexible web and the deformable outer layer at a contacting area are impressed into a surface of the deformable inner layer with a machine-direction nip width W and a nip engagement depth D. When fed into the nip, the baggy web can be spread evenly over the face of the back-up roll, forming a non-baggy surface when going through the coating nip and enabling an even coating across the baggy web. In the absence of the back-up roll, it would be challenging to obtain a thin coating substantially free of coating defects due to the loss of tension locally as the baggy section wraps around the Mayer rod.

In some embodiments, at least one of the machine-direction nip width W and the engagement depth D can be adjusted to adjust a wet thickness of the coating. In some embodiments, a positioning mechanism is provided to control the distance between the Mayer rod and the back-up roll so as to adjust at least one of the machine-direction nip width W and the engagement depth D. In some embodiments, one or more mechanical holders can be provided to press the Mayer rod against the back-up roll. The mechanical holders can be connected to opposite ends of the Mayer rod without touching a coating surface of the Mayer rod that comes in contact with the deformable back-up roll.

Various exemplary embodiments of the disclosure will now be described with particular reference to the Drawings. Referring now to FIGS. 1A-D, a perspective view of a coating apparatus 100 for applying a uniform coating on a baggy web via a Mayer rod over a back-up roll, according to some embodiments. The coating apparatus 100 includes a back-up roll 10 and a Mayer rod 20 that engage with each other to form a coating nip 120 therebetween as the web 3 exits the nip 120. A flexible web 3 of indefinite length material is conveyed in a machine direction 5 into the nip 120. It is to be understood that the web may not be limited to the specific wrap angles as it enters/exits the nip shown schematically in FIGS. 1A-D, but may include any range of entrance/exit web angle.

A coating material 7 is provided on the flexible web 3 upstream of the Mayer rod 20. The coating material 7 can be any coatable material including, for example, water-based solutions, primers, adhesives, inks, dispersions, emulsions, etc. In some embodiments, the coating material 7 may have a viscosity below about 1,000 centipoise (cps), optionally below about 500 cps. The wet coating on the web can be dried or cured to form a coating layer on the web. A uniform coating 9 is formed on the surface 31 of the web 3 that faces the Mayer rod 20. A wet coating thickness refers to coated thickness immediately after the Mayer rod. After drying the coating thickness can be reduced. That reduction of coating thickness is due to a loss of solvent during drying and/or shrinkage of the polymer. Curing can be accomplished by, for example, exposure of the coating to elevated temperature, or actinic radiation. Actinic radiation can be, for example, in the UV spectrum.

The Mayer rod 20 can be a wire wound rod, a double-wire wound rod, a formed rod, a mechanically engraved rod, etc. The wires or engraved/embossed structure on the Mayer rod 20 may be placed closely together (as in a typical wire-wound rod), or may be separated by some distance. The Mayer rod 20 can have a smooth surface or have a portion of its cross-section removed. The Mayer rod can be made from metals, polymers, or ceramics, as well as from any combination of these materials. The Mayer rod can be deformable or undeformable. In some embodiments, the Mayer rod 20 can be a stainless-steel rod that is wound tightly with stainless steel wire of varying diameter to meter the excess coating solution and control the coating weight. In some embodiments, the Mayer rods can be typically cylindrical, having a diameter in a range of, for example, from about 0.5" to about 1.5", or from about 0.25" to about 10". The Mayer rod may work fundamentally by allowing a coating solution to pass through a predefined opening (e.g., the space between two adjacent wires, the space within a formed groove, etc.). In the present disclosure, the predefined opening can remain open as the Mayer rod is pressed into a back-up roll. It is to be understood that a Mayer rod having any suitable configurations can be used herein.

The back-up roll 10 has a deformable inner layer 12 with a surface thereof covered by an outer layer 14. The inner and outer layers 12, 14 may be permanently bonded together in some embodiments and may not be permanently bonded together in other embodiments. It is to be understood that the "outer layer" does not necessarily mean an outermost layer; and the "inner layer" does not necessarily mean an innermost layer. The outer layer 14 has a substantially uniform thickness about the periphery of the inner layer 12. The deformable inner layer 12 is mounted onto a rigid central core 11 (e.g., a metal core) with a substantially uniform thickness about the periphery of the rigid central core 11. In some embodiments, the thickness ratio between the deformable inner layer 12 and the outer layer 14 can be about 3:1 or greater, about 5:1 or greater, about 7:1 or greater, or about 10:1 or greater. In some embodiments, the outer layer 14 has a thickness in the range from about 0.005" to about 0.300", optionally from about 0.005" to about 0.080". As used herein, 1" equals to 2.54 cm. In some embodiments, the deformable inner layer 12 has a thickness in the range from about 0.125" to about 3", optionally from about 0.4" to about 1.0". In some embodiments, compressible rollers described in U.S. Pat. No. 5,206,992 can be used to make the back-up roll herein.

In some embodiments, the material used for the inner layer 12 can be softer than the material used for the outer layer 14. That is, an identical compressive force applied to an identically sized block of each material can result in a larger deformation in the direction of applied force with the softer material than with the harder material. This softness may be provided in several ways, for example by choosing a material with a lower hardness (as indicated using any appropriate hardness scale, such as Shore A or Shore OO), by choosing a material with a lower elastic modulus, by choosing a material with a higher compressibility (typically quantified via a material's Poisson's ratio), or by modifying the structure of the softer material to contain a plurality of gas inclusions, such as a foam or an engraved structure, etc. For example, when the outer layer includes a material having a hardness of 60 Shore A durometer (as measured using ASTM D2240), then the hardness of the inner layer may be less than 60 Shore A durometer. It should be noted that in some cases the hardness may be most appropriately measured using different scales for the inner and outer layer (e.g., Shore A durometer for the outer layer and Shore OO for the inner layer). In some embodiments, the compressibility of the inner layer may be measured via Compression Force Deflection Testing per ASTM D3574 when the inner layer is foam; and via Compression-Deflection Testing per ASTM D1056 when the inner layer is a flexible cellular material such as, for example, sponge or expandable rubber. The inner layer may have a compressibility of less than about 45 psi at 25% deflection, optionally less than about 20 psi at 25% deflection.

In some embodiments, the outer layer 14 can be made of material(s) that are substantially incompressible, e.g., the relative volume change of the material in response to a contact pressure is less than 5%, less than 2%, less than 1%, less than 0.5%, or less than 0.2%. The inner layer 12 is configured to be elastically deformable, e.g., being capable of substantially 100% (e.g., 99% or more, 99.5% or more, or 99.9% or more) recovering to its original state after being deformed. In some embodiments, the inner layer 12 can be compressible to provide the desired deformability. In some embodiments, the inner layer 12 may be substantially incompressible, but sufficiently soft to provide the desired deformability. In some embodiments, the inner layer 12 may be a layer made of substantially incompressible material which has been patterned, 3D printed, embossed, or engraved to provide the desired deformability.

In some embodiments, the deformable outer layer 14 can have a lower compressibility than the deformable inner layer 12. In some embodiments, the hardness of the deformable outer layer can be greater than about 40 Shore A, optionally greater than about 50 Shore A. In some embodiments, the hardness of the deformable inner layer can be less than about 20 Shore A, optionally less than about 10 Shore A. In some embodiments, the inner layer may have a higher compressibility than the outer layer. The inner layer can have a compressibility less than about 45 psi at 25% deflection, optionally less than about 20 psi at 25% deflection. In some embodiments, the outer layer can have a Poisson's ratio greater than about 0.1, greater than about 0.2, greater than about 0.3, or preferably greater than about 0.4. In some embodiments, the deformable inner layer can have a Poisson's ratio less than about 0.5, less than about 0.4, less than about 0.3, or preferably less than about 0.2. In some embodiments, the deformable inner layer can have a negative Poisson's ratio.

In some embodiments, the deformable outer layer can include one or more materials of an elastomer, a metal, a fabric, or a nonwoven. In some embodiments, the outer layer can be a substantially incompressible elastomer having a hardness greater than about 40 Shore A, or optionally greater than about 50 Shore A. The thickness of the outer layer of the back-up roll can be less than about 10 mm, less than about 5 mm, or less than about 2 mm. Suitable elastomers may include thermoset elastomers such as, for example, Nitriles, fluoroelastomers, chloroprenes, epichlorohydrins, silicones, urethanes, polyacrylates, EPDM (ethylene propylene diene monomer) rubbers, SBR (styrene-butadiene rubber), butyl rubbers, nylon, polystyrene, polyethylene, polypropylene, polyester, polyurethane, etc.

In some embodiments, the deformable inner layer can include one or more materials of a foam, an engraved, structured, 3D printed, or embossed elastomer, a fabric or nonwoven layer, or a soft rubber. The inner layer of the back-up roll can have a hardness less than about 20 Shore A, or less than about 10 Shore A. A suitable foam can be open-celled or closed-celled, including, for example, synthetic or natural foams, thermoformed foams, polyurethanes, polyesters, polyethers, filled or grafted polyethers, viscoelastic foams, melamine foam, polyethylenes, cross-linked polyethylenes, polypropylenes, silicone, ionomeric foams, etc. The inner layer may also include foamed elastomers, vulcanized rubbers, including, for example, isoprene, neoprene, polybutadiene, polyisoprene, polychloroprene, nitrile rubbers, polyvinyl chloride and nitrile rubber, ethylene-propylene copolymers such as EPDM (ethylene propylene diene monomer), and butyl rubber (e.g., isobutylene-isoprene copolymer). A suitable foam inner layer of the back-up roll can have a compressibility, for example, less than about 45 psi at 25% deflection, or less than about 20 psi at 25% deflection. It is to be understood that the inner layer may include any suitable compressible structures such as, for example, springs, nonwovens, fabrics, air bladders, etc. In some embodiments, the inner layer 12 can be 3D printed to provide desired Poisson's ratio, compressibility, and elastic response.

Figure 2A:
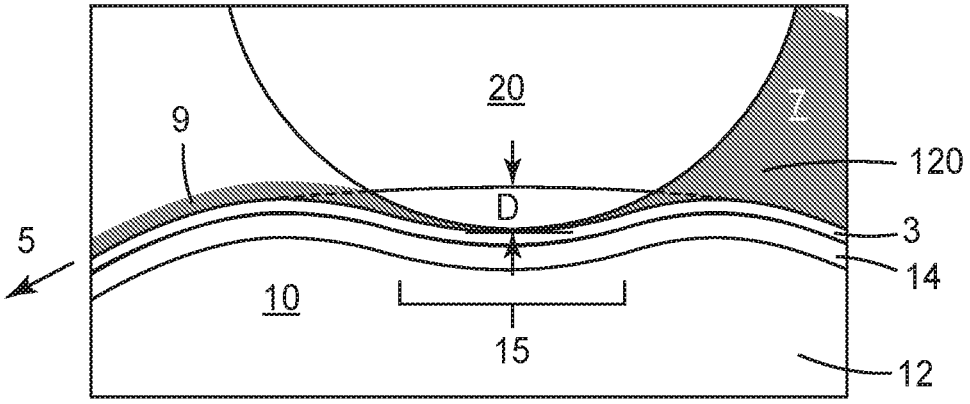
FIG. 2A is an enlarged portion view of FIGS. 1A-1D.

As shown in FIGS. 1A-D, the flexible web 3 is conveyed along a web path and fed into the nip 120. FIG. 2A illustrates an enlarged portion view of any one of FIGS. 1A-D. The back-up roll 10 can rotate about an axis thereof to transport the web 3 along the down-web direction 9 and through the nip 120. The back-up roll 10 can be rotated using a motor, or can be rotated simply due to frictional contact with the flexible web 3. The Mayer rod 20 may rotate with the web 3 (commonly referred to as "forward" rotation), or against the web 3 (commonly referred to as "reverse" rotation). In some embodiments, the Mayer rod 20 may rotate at a speed independent or different from the web speed. The Mayer rod 20 may rotate at a surface speed in a range, for example, from about 1.0 m/min to about 50 m/min. In some embodiments, the Mayer rod 20 can be stationary. In some embodiments, the Mayer rod 20 can oscillate in cross-web direction.

The flexible web 3 can include any suitable flexible substrate, such as, for example, a polymer web, a paper, a polymer-coated paper, a release liner, an adhesive coated web, a metal coated web, a flexible glass or ceramic web, a nonwoven, a fabric, or any combinations thereof. The flexible web 3 is disposed between the back-up roll and the Mayer rod, wrapping around at least one of the back-up roll and the Mayer rod with various wrap angles. In some embodiments, the flexible web 3 can wrap the Mayer rod with a wrap angle in the range, for example, from about 1 to about 180 degrees, about 1 to about 120 degrees, about 1 to about 90 degrees, or about 1 to about 60 degrees. In some embodiments, the flexible web 3 can wrap the back-up roll with a wrap angle in the range, for example, from about 1 to about 180 degrees, about 1 to about 120 degrees, about 1 to about 90 degrees, or about 1 to about 60 degrees. It is to be understood that the entrance/exit angles between the flexible web and the nip may not be limited by the above ranges.

The flexible web 3 may exhibit distortions or non-flatness characteristics when it is conveyed along the web path as a baggy web. The non-flatness characteristics may include, for example, lanes, strips, bumps, ripples, etc. FIG. 1' illustrates exemplary non-flatness characteristics 43' on the baggy web 3', which can be located on any portions of the web (e.g., center or edge). In the free-span coating of FIG. 1', the surface portions of the web 3' having such non-flatness characteristics 43' may result in variations (e.g., coating defects 44' over the non-flatness characteristics 43') in coat weight across the baggy web 3' that is conveyed along the down-web direction 5'. The methods and apparatuses described herein can significantly mitigate the variations induced by the non-flatness characteristics of a baggy web.

As shown in FIG. 2A, the Mayer rod 20 is pressed against the back-up roll 10 to form the nip 120, where the Mayer rod 20 and the flexible web 3 at a contacting area 15 are impressed into a deformable surface of the back-up roll 10 with a nip width W along the machine direction and a nip engagement depth D. In some embodiments, the machine-direction nip width W may be in a range, for example, from about 0.1 mm to about 50 mm. In some embodiments, the engagement depth D can be within a range, for example, from about 0.01 mm to about 10 mm, from about 0.05 mm to about 5 mm, or from about 0.1 mm to about 1 mm. With such engagement with the Mayer rod 20, the back-up roll 10 can rotate with sufficient smoothness.

In some embodiments, the back-up roll may not be perfectly cylindrical, with a departure from cylindricity quantified using a total indicated runout (TIR), which can be defined as the difference between the largest and smallest values of the radius on the roll. For example, a roll with a maximum radius of 150.100 mm in one location, and a minimum radius of 150.000 mm in another location, would have a TIR of 0.100 mm. When the back-up roll engages a Mayer rod and rotates, the nonuniformities in roll radius may translate through the nip formed between the back-up roll and the Mayer rod. The differences in radius can produce a difference in pressure within a coating (e.g., in a liquid phase), resulting in a nonuniform coating. The impact of this nonuniformity can be diminished by increasing the softness of the back-up roll (thereby making it easier to deform under fluid or mechanical pressure), though it is well known in industry that soft materials can be more difficult to machine into precise shapes. One of the benefits of the present disclosure is that the thin, outer layer can present a harder surface, and so is more practical to machine, without sacrificing the overall softness of the roll construction. In some embodiments, the TIR of the back-up roll 10 may be, for example, no greater than about 100 micrometers, or no greater than about 50 micrometers.

Figure 2B:
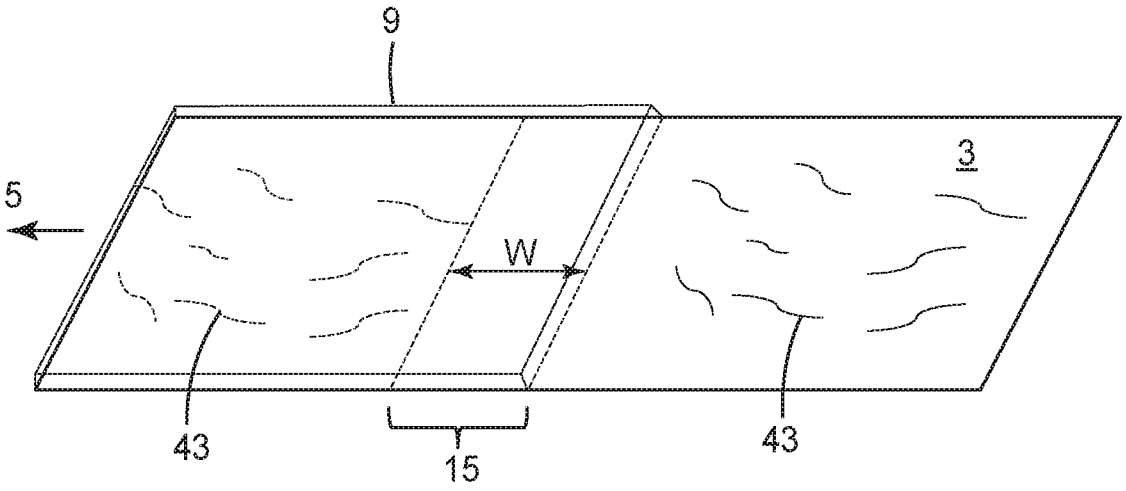
FIG. 2B is a perspective view of the web of FIGS. 1A-1D.
Figure 2C:
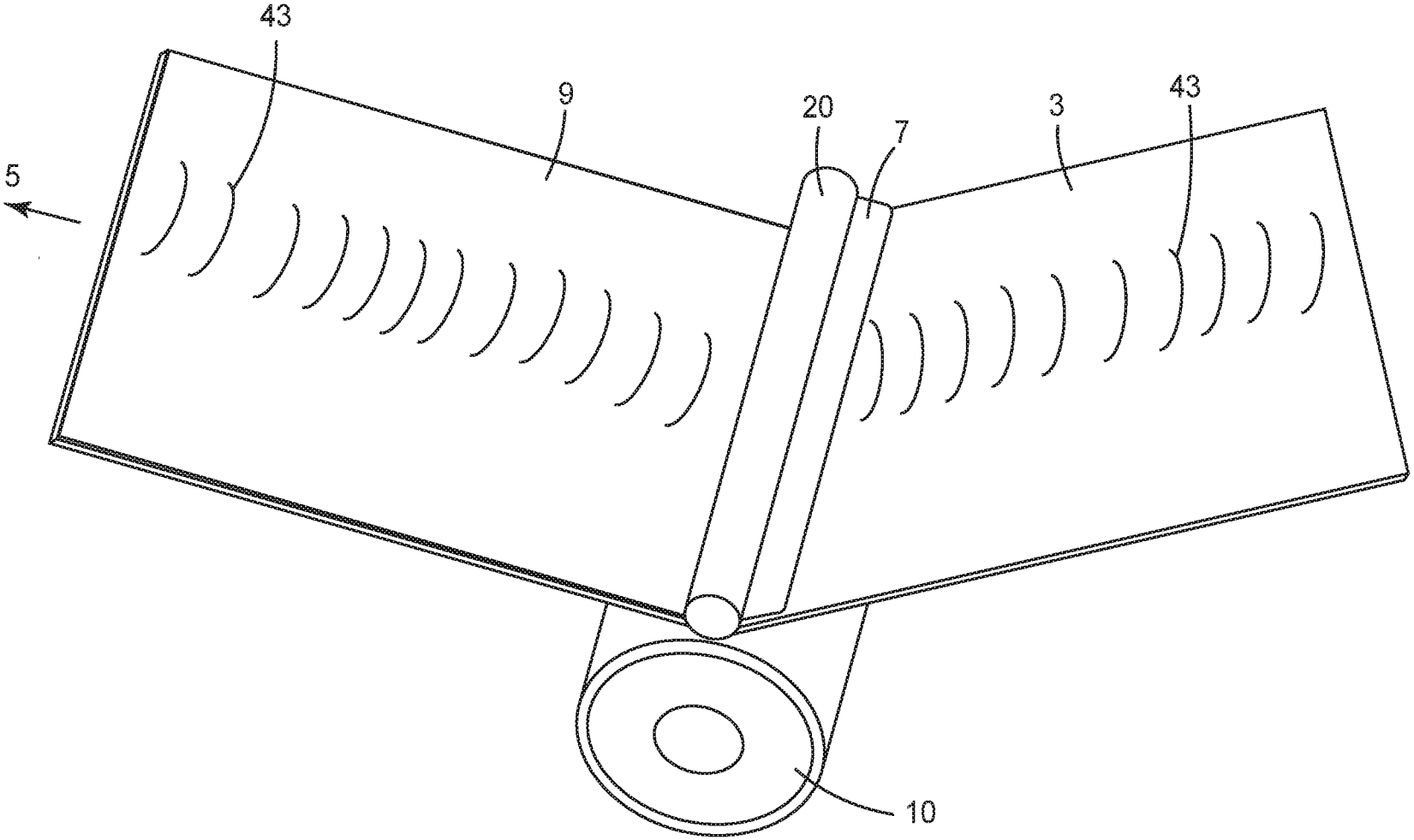
FIG. 2C is a perspective view of the coating apparatus of FIG. 1D.

Referring again to FIG. 2A, the portion of flexible web 3 at the contacting area 15 is impressed, via the Mayer rod 20, into the face of the back-up roll 10 with the machine-direction nip width W and the engagement depth D. The Mayer rod 20 can apply a uniform force at the contacting area 15 across the web. Upon the applied force, the flexible web 3 can spread evenly along the cross-web direction over the face of the back-up roll 10. A non-baggy surface of the flexible web 3 can be formed when the web goes through the coating nip 120. As shown in FIGS. 2B-C, the non-flatness characteristics 43 are significantly reduced in the contacting area 15, where the coating material 7 is applied to form an even coating 9 on the non-baggy surface of the web 3 that contacts the Mayer rod 20. The non-flatness characteristics 43 on the baggy web may restore after the flexible web 3 exits the contacting area 15, which may not affect the uniformity of the coating already formed on the web.

The coating 9 can have a substantially uniform thickness across the surface of the flexible web 3. In addition, when the web 3 is conveyed through the coating nip 120 by, e.g., rotating the back-up roll 10, the back-up roll 10 has sufficiently low total indicated runout (TIR, e.g., less than 100 micrometer, preferably less than 50 micrometer), which helps to maintain a uniform force to create uniform coating along the down-web direction.

Figure 3A:
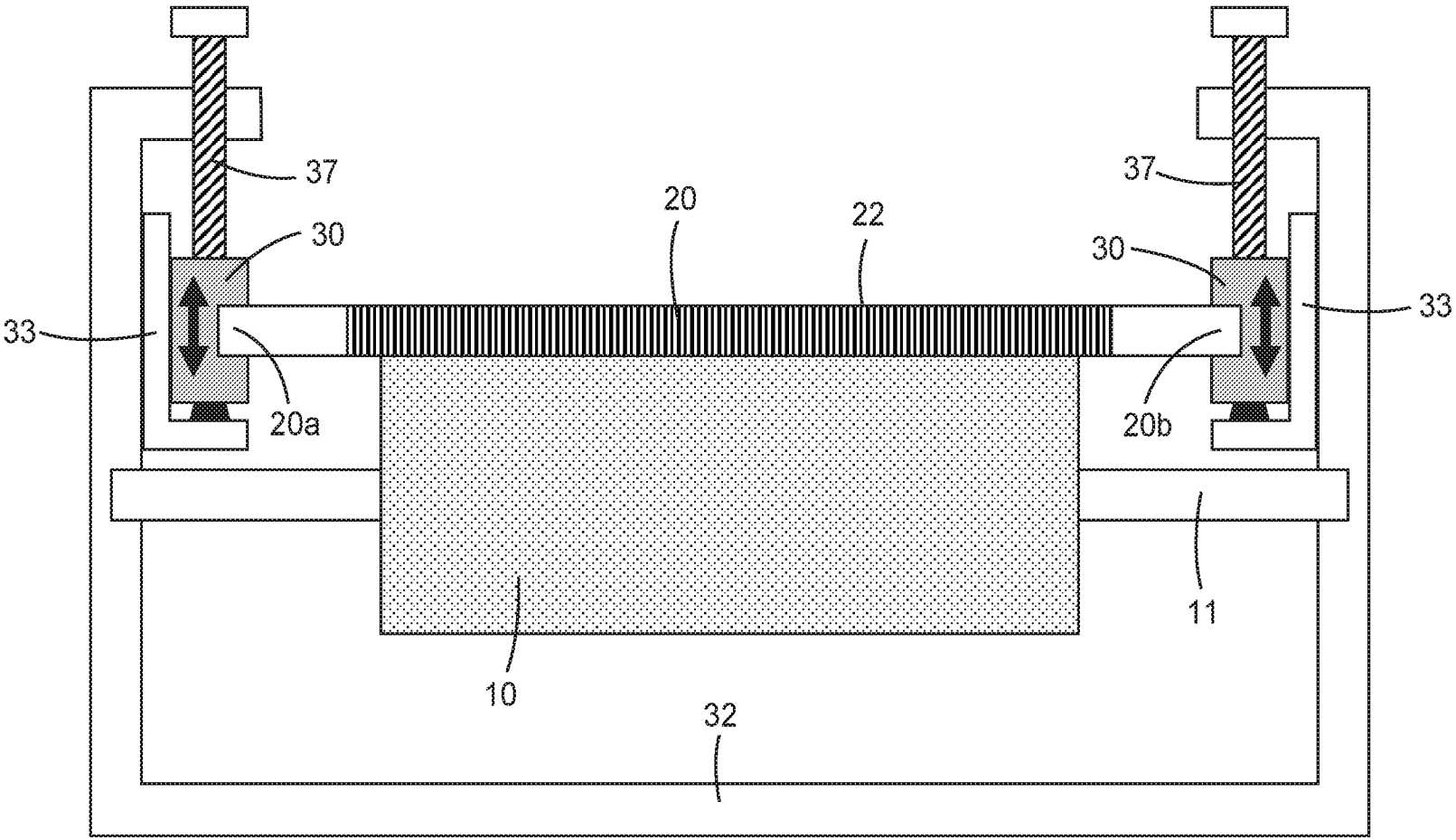
FIG. 3A is a schematic diagram of a coating apparatus including a mounting and positioning mechanism, according to one embodiment.
Figure 3B:
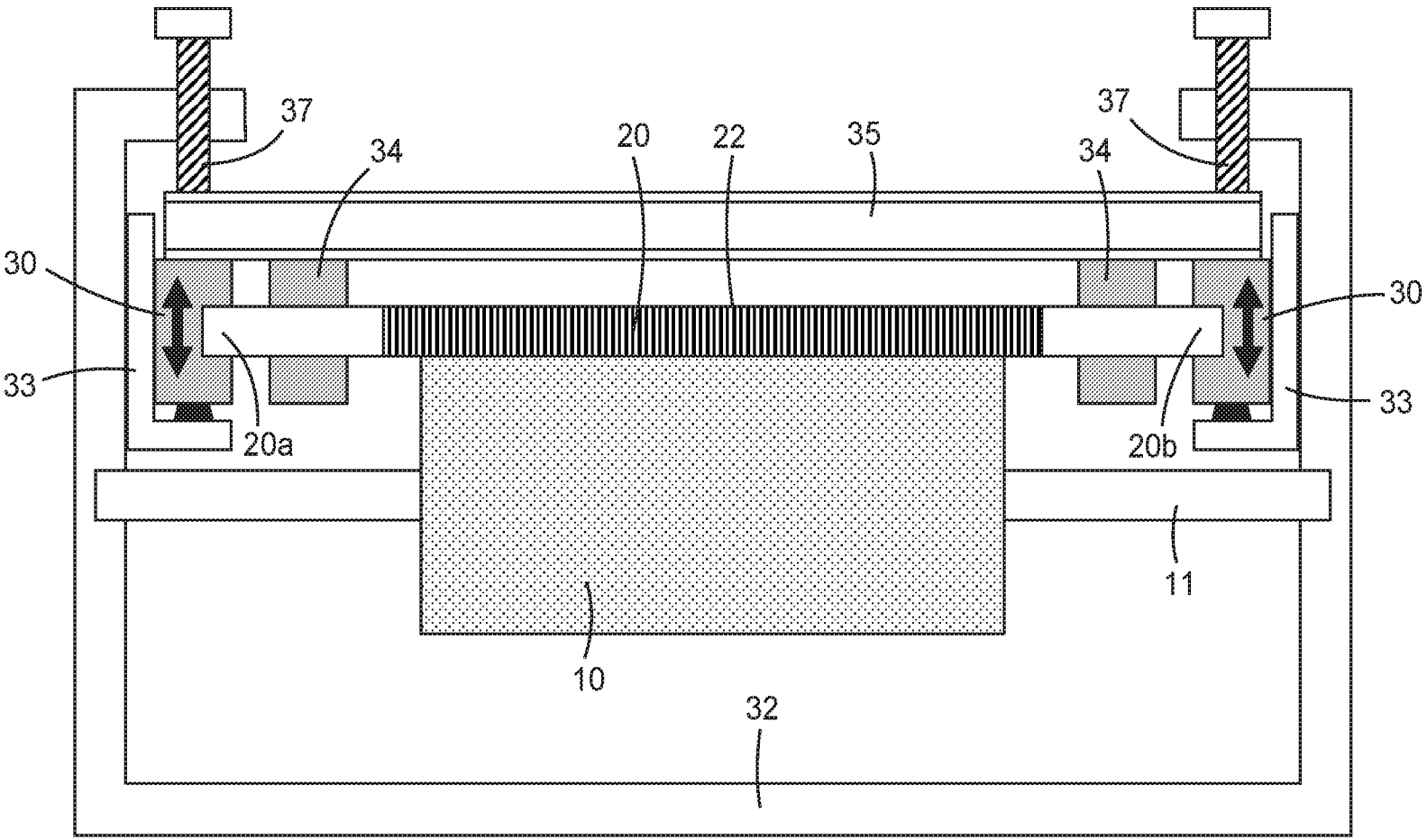
FIG. 3B is a schematic diagram of a coating apparatus including a mounting and positioning mechanism, according to another embodiment.

FIGS. 3A-B illustrate exemplary mounting and positioning mechanisms for at least one of the Mayer rod 20 and the back-up roll 10. As shown in FIG. 3A, a rigid shaft 11 is used to mount the backup roll 10 onto a machine frame 32. The Mayer rod 20 has a round shape and is mounted to the machine frame 32 via a mounting assembly, which can adjust the relative distance between the respective axes of the Mayer rod 20 and the backup roll 10. The mounting assembly includes a mechanical holder 30 attached to opposite ends 20*a*, 20*b* of the Mayer rod 20. The mechanical holder 30 can include, for example, a pair of bearings. The opposite ends 20*a* and 20*b* of the Mayer rod 20 can be rotatably attached to the bearings of the mechanical holder 30. The position of the mechanical holder 30 can be adjusted towards and away from the back-up roll 10 to produce a substantially uniform pressure or force in the cross-web direction. This adjustment can be performed in any number of ways that are well known in the coating industry. For example, one could use mechanical slides, a differential screw positioner, a servo motor, a pressurized air cylinder, or any other appropriate means or combination of appropriate means for adjustment of the Mayer rod position. In the embodiment shown in FIG. 3A, a differential screw positioner 37 is shown that can adjust the position of the mechanical holder along a slide 33 that is fixed to the machine frame 32. It is noted that there is a mounting assembly on each end of the Mayer rod, thereby attaching the Mayer rod 20 to the machine frame 32 on each side of the frame. It is also noted that the mounting assembly does not contact the coating surface 22 of the Mayer rod 20 which comes in contact with the deformable back-up roll and can meter a coating solution onto a flexible web. Such a non-contacting configuration is desirable in some applications to avoid issues with the coating solution accumulating on the mechanical holder or possible contamination.

The mounting and positioning mechanism of FIG. 3B further includes additional support bearings 34 respectively mounted on the Mayer rod 20 adjacent to the ends 20*a* and

20*b*. The support bearings 34 can provide a torque or twisting force at the ends of the Mayer rod to reduce the amount of deflection at its center. A stiffening beam 35 is provided to support the paired sets of bearings 30 and 34 in maintaining a more consistent engagement depth D between the Mayer rod and back-up roll (e.g., the compressible inner and out layers mounted on the rigid core) over the entire length of the back-up roll 10. The stiffening beam 35 can be positioned to be substantially parallel to the Mayer rod 20, extending between the opposite mechanical holders 30, without touching the coating surface 22 of the Mayer rod 20.

It is to be understood that FIGS. 3A-B illustrate exemplary mounting and positioning mechanisms. Any other suitable mounting and positioning mechanisms can be used to mount and position the Mayer rod 20 and the back-up roll 10. In some embodiments, a positioning mechanism may be functionally connected to at least one of the Mayer rod 20 and the back-up roll 10 to control the relative distance between the respective axes of the Mayer rod and the back-up roll so as to adjust at least one of the machine-direction nip width W and the engagement depth D. In some embodiments, the relative position of the Mayer rod and the back-up roll can be adjusted by fixing the position of the roll and using one or more mechanical holders on the edges of the Mayer rod to adjust the position of the Mayer rod. In some embodiments, the relative position of the Mayer rod and the back-up roll can be adjusted by fixing the position of the Mayer rod and changing the position of the back-up roll. In some embodiments, a positioning mechanism can further include one or more positioning sensors to detect the relative distance between the respective axes of the back-up roll and the Mayer rod, and one or more stepper motors to move at least one of the back-up roll and the Mayer rod to adjust the distance therebetween.

In general, the Mayer rod can be used to meter a layer of coating material onto a web. Different Mayer rods can be used to obtain different thicknesses. It is well known in the art that changing Mayer rod geometry is a convenient method of adjusting coating thickness, when it is desired to substantially increase or decrease the coating thickness, different Mayer rod(s) may to be used. In the present disclosure, by using the Mayer rod in combination with a back-up roll, the coating thickness can be also adjusted on the flexible web simply by altering the nip width W and/or depth D, without changing the Mayer rod.

In some embodiments, the machine-direction nip width W and/or the engagement depth D between the Mayer rod 20 and the back-up roll 10 can be adjusted to adjust/control the thickness of coating 9 on the flexible web 3 without changing the Mayer rod 20. For example, the engagement depth D can be increased to obtain a thinner coating 9, or decreased to obtain a thicker coating 9. The engagement depth D can be adjusted to be within a range, for example, from about 0.01 mm to about 10 mm, from about 0.05 mm to about 10 mm, or from about 0.1 mm to about 5 mm. The machine-direction nip width W can be adjusted to be in a range, for example, from about 0.1 mm to about 50 mm. The coating thickness can be controlled in a range, for example, about 5 to about 200 micrometers.

In some embodiments, the machine-direction nip width W and/or the engagement depth D can be adjusted by positioning the Mayer rod and the back-up roll such that the relative distance between the respective axes of the Mayer rod and the back-up roll is less than the sum of the respective radii and the thickness of the flexible web and the coating material. The relative position of the Mayer rod and the back-up roll can be adjusted using a mounting and positioning mechanism such as, for example, the mounting and positioning mechanism in FIGS. 3A-B. It is to be understood that in some embodiments, the Mayer rod can have a round shape or a non-round shape. The machine-direction nip width W and/or engagement depth D can be adjusted by positioning the Mayer rod and the back-up roll such that the Mayer rod intersects the curved plane defined by the surface of the back-up roll in its un-deformed state.

In some embodiments, the engagement depth D can be controlled to be greater than a critical value to provide a uniform coating on a baggy web. The critical depth can be determined to be larger than any nonuniformity in the roll which may be from a roll TIR, or any point defects. When the engagement depth D is controlled within a certain range that is greater than the critical value, a contact pressure between the Mayer rod and the back-up roll at the contacting area can be provided, which may not significantly change the engagement depth D. This provides a stable window for uniform coating (e.g., the relative change of the contact weight/thickness is less than 10%, less than 5%, less than 2%, less than 1%, or less than 0.5% along the cross-web direction).

Figure 7A:
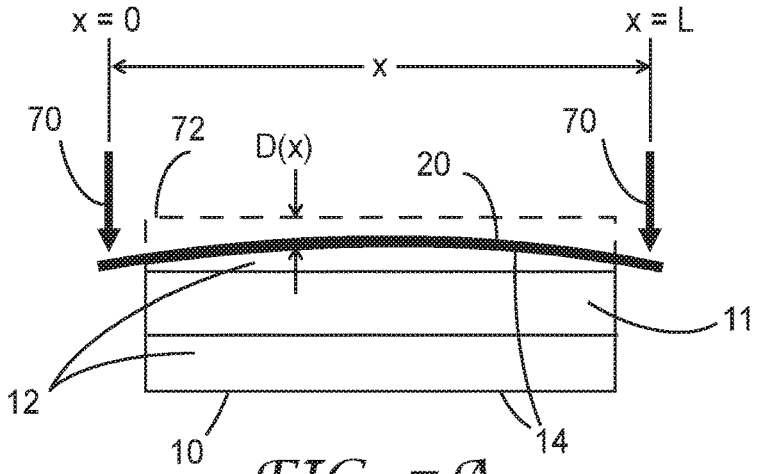
FIG. 7A illustrates deflection of a Mayer rod engaged with a back-up roll.

The present disclosure recognizes the importance of controlling the machine-direction nip width W, the engagement depth D, and/or the corresponding nip contact pressure between the Mayer rod and back-up roll over the entire length of the back-up roll in the cross-web direction. In some embodiments, when a Mayer rod engages with a back-up roll, the contact force on the Mayer rod may cause the center portion of the Mayer rod to deflect away from the back-up roll as shown in FIG. 7A. Such deflection may reduce the engagement depth D at the center portion thereof. One method of reducing the degree of deflection in the Mayer rod is to use two bearings at each end of the Mayer rod support mechanism as shown in FIG. 3B. The additional support bearings 34 can provide a torque or twisting force at the ends of the Mayer rod to reduce the amount of deflection at its center. It may be desirable from a practical design perspective to include the stiffening beam 35 to support the paired sets of bearings 30 and 34, in maintaining a more consistent engagement depth D between the Mayer rod and back-up roll over the entire length of the back-up roll.

It is useful to provide a quantitative description of the qualities of the back-up roll covering that confer the unexpected performance advantages of this disclosure. For example, it has been found that solid rubber covers, even those having a very low modulus, may not perform as well as dual layer covers having a thin solid rubber outer layer over a compressible inner layer. Furthermore, even dual layer covers having a very thin compressible inner layer may not confer the desired coating uniformity over the entire length of the back-up roll. For example, U.S. Pat. No. 6,079,352 describes a roll with an inner compressible layer thickness between "about 0.3175 cm and about 1.27 cm" and often "about 0.635 cm" with an outer layer thickness between "about 0.0127 and about 0.1524 cm". As shown in the example section below, a back-up roll D1, which has a compressible inner layer thickness of 0.404 cm and an outer layer thickness of 0.152 cm that fall within the ranges specified by U.S. Pat. No. 6,079,352, but failed to confer desired coating uniformity over the entire length of the back-up roll.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

Examples

These Examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Examples of Back-Up Roll

Quantitative roll covering characterization was conducted on a selection of back-up rolls 10 described in Table 1 below. The back-up rolls have various roll-cover configurations mounted on a rigid core. The back-up rolls labeled R1, R2, D1, D2, and D3 were used for mechanical testing. Diameters for the Test Roller and the Test Plate are provided for reference. The foam inner layers of rolls D1, D2, and D3 and a separate roll (not listed in Table 1) with only a single foam layer and no outer rubber layer were all constructed of the same material, a closed-cell polyurethane foam provided by American Roller Company, with varying thicknesses. Roller R1 was commercially available from Finzer Roller, Des Plaines, Ill. Rollers R2, D1, D2 and D3 were commercially available from American Roller Company, Union Grove, Wis.

TABLE 1

| | Diameter | | Rubber Layer | | | Foam | S-Factor | |
|---|---|---|---|---|---|---|---|---|
| Roller Name | Outside (mm) | Core (mm) | Thickness (mm) | Hardness (Shore A) | Modulus (MPa) | Thickness (mm) | Average ($10^8 \cdot N/m^{5/2}$) | Slope ($10^6 \cdot N/m^{7/2}$) |
| R1 - Medium Rubber | 120 | 95 | 12.7 | 65 | 5.6 | — | 31.0 | 61233 |
| R2 - Soft rubber | 120 | 100 | 10.1 | 20 | 0.74 | — | 6.3 | 8868 |
| D1 - Dual layer thin | 110 | 99 | 1.52 | 60 | 4.27 | 4.04 | 21.6 | 11517 |
| D2 - Dual layer medium | 120 | 100 | 2.54 | 55 | 3.21 | 7.54 | 5.4 | 34 |
| D3 - Dual layer thick | 165 | 127 | 1.65 | 49 | 2.26 | 17.3 | 2.7 | −102 |
| Test Roller | 90 | | | | | | | |
| Test Plate | ∞ | | | | | | | |

Test Methods

The following test methods have been used in evaluating some of the Examples of the present disclosure.

Shore A Hardness Measurements

The Shore A hardness measurement of the rubber layers in Table 1 was measured, on the ASTM D2240 type A scale, using a Model 306L durometer tester manufactured by Pacific Transducer Corporation of Los Angeles, Calif. The hardness values in the table are an average of individual hardness measurements obtained from three cross-web locations at three positions around the circumference of each roller. It is understood that the hardness measurement mainly reflects the material properties of the outer rubber layer of the roller, though it may also be affected by the properties of the underlying foam layer.

Shore OO Hardness Measurements

Using the same procedure described above, the hardness of the separate foam roller without an outer rubber layer was measured to be 35 on the ASTM D2240 type OO scale, using a Model 1600 durometer tester with a MS-OO indenter manufactured by Rex Gauge Company of Buffalo Grove, Ill. It was not possible to measure the hardness of the foam layers in rollers D1, D2 and D3 of Table 1 because of the presence of the outer rubber layer. As rollers D1, D2, D3 and the separate foam roller were all manufactured by the American Roller Company, using the same manufacturing process, it is assumed that the hardness of the foam layers in rollers D1, D2 and D3 is similar to that of foam roller, namely 35 on the OO durometer scale.

Modulus Measurements

The Young's modulus values in Table 1 were obtained from the measured hardness values using a formula presented in a paper by J. K. Good, "Modeling Rubber Covered Nip Rollers in Web Lines", Proceedings of the Sixth International Conference on Web Handling, Oklahoma State University, 2001.

Mechanical Compression Testing

Figure 4B:
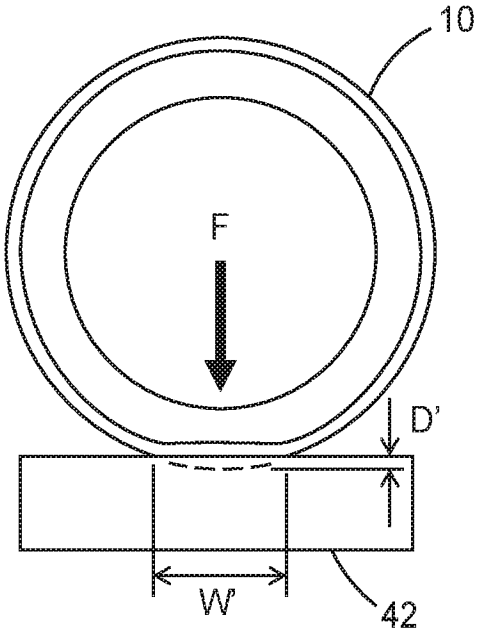
FIG. 4B is a schematic diagram of a back-up roll engaged with a test plate for mechanical compression testing.
Figure 4A:
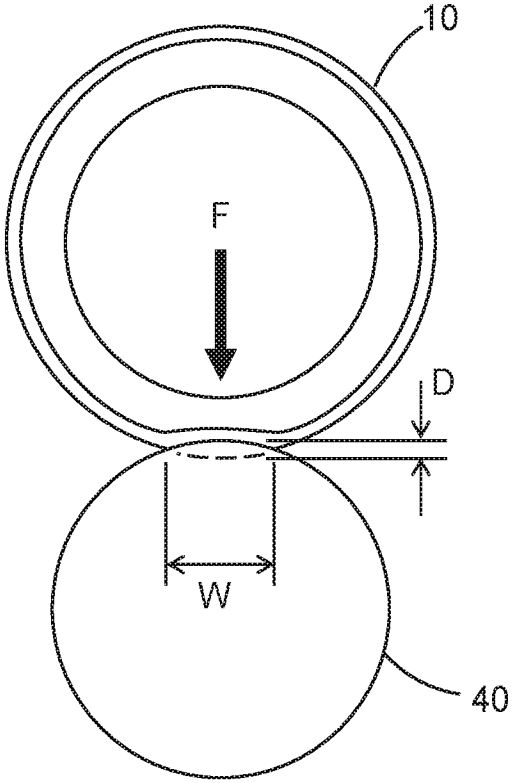
FIG. 4A is a schematic diagram of a back-up roll engaged with a test roller for mechanical compression testing.

Mechanical compression testing using a mechanical testing machine, such as those manufactured by Instron Corporation, is well understood by those versed in the art. Referring to FIGS. 4A and 4B, rolls, labeled 10 in the figures and designated R1, R2, D1, D2, and D3 in Table 1, were first pressed into a Test Roller 40 having an outside diameter of 90 mm as shown in FIG. 4A and second into a Test Plate 42, corresponding to a flat plate having an essentially infinite outside diameter as shown in FIG. 4B in an Instron (Model 5500R) universal mechanical testing machine. The mechanical testing machine engaged each roller over a range of engagement depths D or D' and width W or W' at a constant speed 83.8 micrometers/s. The engagement depth and the contact force between the roll 10 and the Test Roller or Test Plate were measured and recorded using the Instron's frame position sensor and force load cell. The force versus engagement curve was then plotted for each test. Two such representative force versus engagement curves for the back-up roll D2 are shown in FIG. 5.

Figure 5:
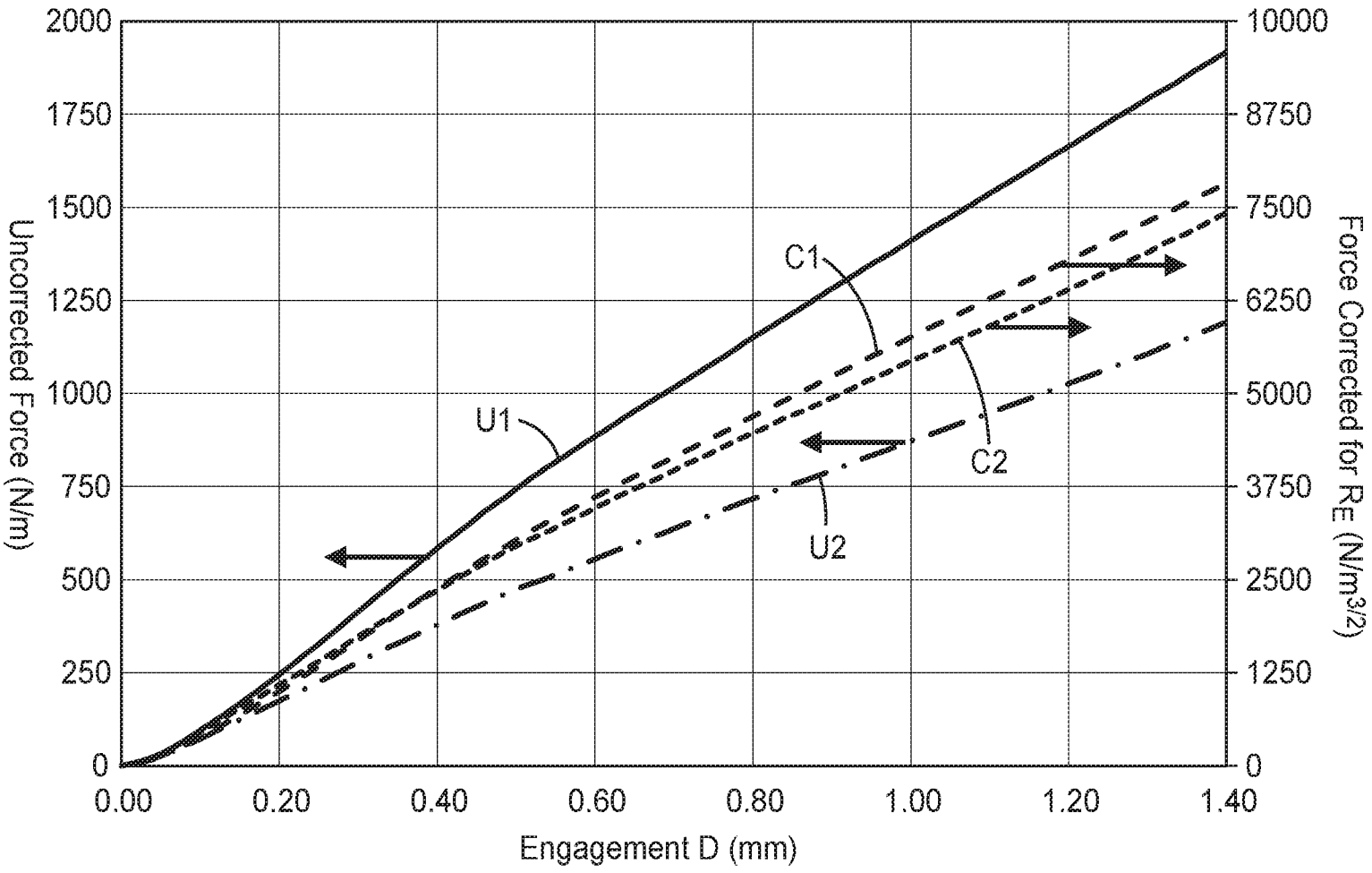
FIG. 5 illustrates force versus engagement curves for the mechanical compression testing in FIGS. 4A-B.

Referring to FIG. 5, data U2 represents the force vs. engagement curve for the roller D2 in Table 1 engaged with the Test Roller 40 of FIG. 4A, while U1 represents the curve for the roller D2 engaged with a flat surface Test Plate 42 of FIG. 4B. As can be appreciated from FIGS. 4A and 4B, engaging the roller D2 with the Test Plate requires the displacement and or compression of more cover material, and therefore more force F, than a comparable level of engagement of D2 with Test Roll. Correspondingly the force vs. engagement curve U1 rises more steeply than curve U2. As neither the Test Plate or Test Roller necessarily represent the condition of engaging a Mayer rod of arbitrary diameter into roller D2, well established principles in the field of contact mechanics may be used to generate force vs. engagement data that are independent of the geometry used for mechanical testing, as described in the S-Factor determination.

S-Factor Determination A formula was derived for the force F required to engage a roller having a solid deformable cover a distance D into a rigid roller or flat surface. See formula 5.74 in Contact Mechanics; K. L. Johnson; Cambridge University Press 1985; Lib. of Congress catalog: 84-11346. Summarizing this formula and recasting variables into those used in FIGS. 4A and 4B we have the following equation:

$$F=K\cdot D3/2\cdot\sqrt{R_E} \quad [1]$$

where F represents the applied force, normalized to a unit length of roller contact, a constant K encompassing the modulus, Poisson's ratio, compressibility and thickness of each of the layers making up the deformable cover, the engagement D of the deformable cover into a rigid roller or surface, and $R_E$ the effective radius given by $$R_E = \frac{D_1 \cdot D_2}{2\cdot(D_1 + D_2)} \quad [2]$$

where $D_1$ and $D_2$ representing the diameters of the two rollers or surfaces in contact with each other, and a flat plate corresponding to an essentially infinite roller diameter.

The data represented by curves U1 and U2 in FIG. 5 may be rendered into a geometrically invariant form by correcting for the geometry of the fixture used to obtain the data, namely Test Roller, 40 in FIG. 4A or Test Plate, 42, in FIG. 4B. Using the relationship between F and $R_E$ in Equation [1], geometry corrected data C1 in FIG. 5 were obtained by dividing data U1 by the square root of $R_{E\text{-}Flat}$, equal to 60.1 mm and calculated using Equation [2], for engaging the roller D2 into the Test Plate. A similar geometric correction was applied to obtain data C2 from U2 in FIG. 5 by dividing by the square root of $R_{E\text{-}Roll}$, equal to 25. 8 mm, for engaging the roller D2 into the Test Roller. To within a small experimental error, the curves C1 and C2 in FIG. 5 are equal. This shows the corrected force vs. engagement data in C1 and C2 are in fact geometrically invariant, or in other words are not dependent on the original geometric differences between the Test Roller and the Test Plate used to obtain the uncorrected compression test data U1 and U2.

To obtain force vs. engagement data from C1 and C2 for an application, for example engaging a 38.1 mm diameter Mayer rod into roller D1 from Table 1, the previously corrected force data can be multiplied by the square root of $R_E$ that is appropriate for the application geometry. Using this procedure, the geometrically invariant data can be recast into a form that is appropriate for the application. It should be noted that this geometric correction procedure, transforming force vs. engagement data obtained from a compression testing apparatus to a geometrically invariant form and then transforming again for modeling a Mayer rod coating apparatus, is valid only if the parameter K in Equation [1] is held substantially constant. For the purposes of this application K is considered constant, even for back-up rollers having different diameters, if the roller covers are constructed in an equivalent manner, having the same layers, made of similar materials with the same layer thicknesses.

A parameter, S-Factor, may be obtained by dividing the geometrically corrected force vs. Engagement data C1 or C2, based on FIG. 5, by the roller engagement D.

$$S = \frac{F}{D\cdot\sqrt{R_E}} \quad [3]$$

The calculation in Equation [3] is carried out individually for each data pair ($F_i$, $D_i$) obtained from the mechanical compression test described previously. The S-Factor is related to the slope of the corrected force data C1 and C2 in FIG. 5, having the same units of measure, namely $N/m^{5/2}$. It should be noted that this S-Factor is not a true local slope because it depends on the magnitude of the corrected force datum $F_i$ and total engagement value $D_i$ used to obtain that force.

Figure 6:
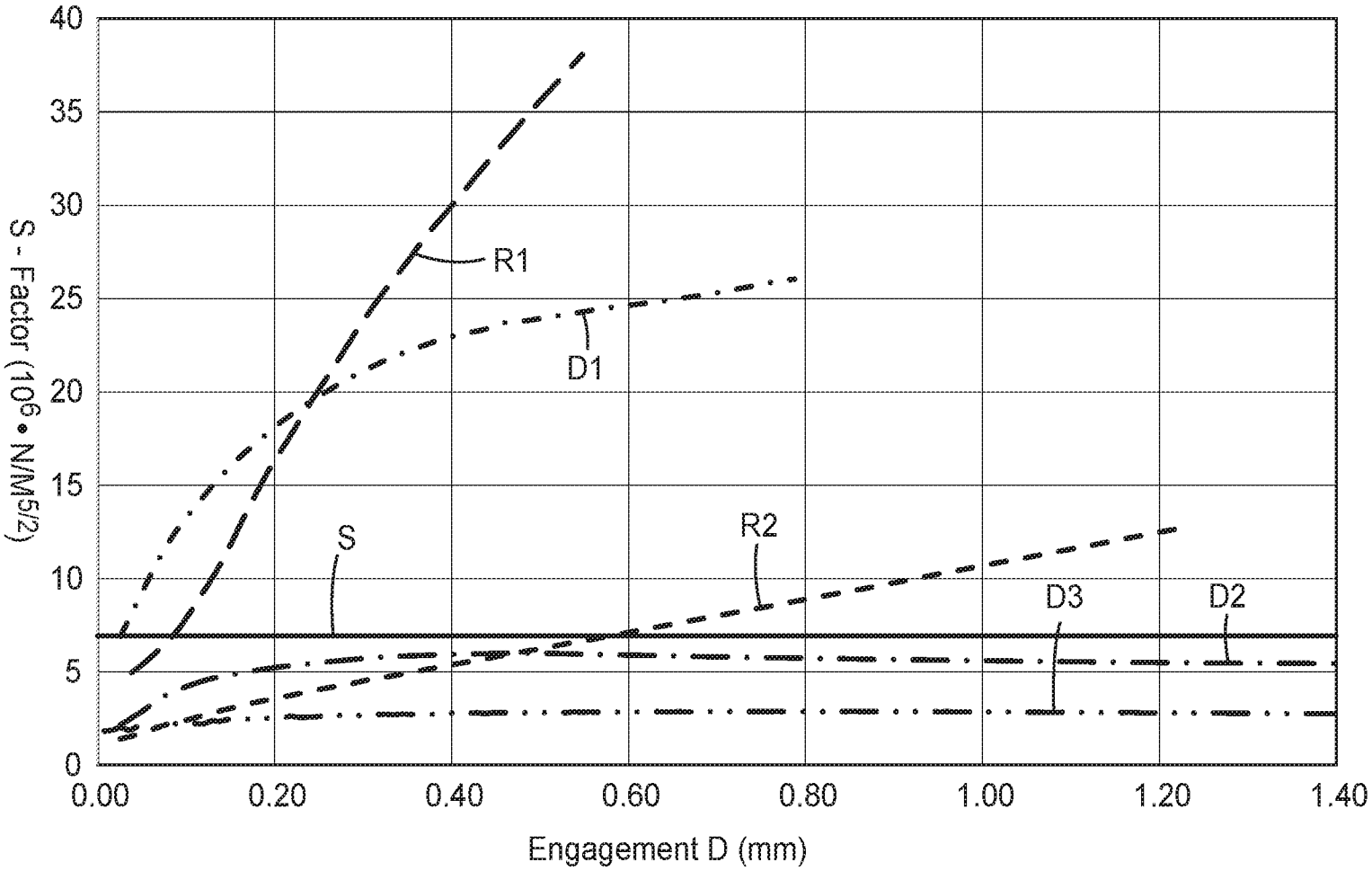
FIG. 6 illustrates plots of slope factor S versus engagement depth D for various back-up rolls.

S-Factors calculated for rollers R1, R2, D1, D2 and D3 in Table 1 are shown as a function of roller engagement D in FIG. 6. S-Factors quantitatively describe intrinsic design properties of the roller covers in Table 1 and are governed by the thickness, modulus, Poisson's ratio or compressibility of the various layers covering the rigid core of the back-up roll. Because of the aforementioned geometric correction procedure for experimentally obtained force data, S-Factors do not depend on the lengths or diameters of the Test Roller 40 in FIG. 4A or Test Plate 42 in FIG. 4B. Likewise, when used to calculate cross-web engagement D and nip contact pressure F, S-Factors do not depend on the lengths or diameters of a Mayer rod or back-up roll in contact with each other.

Referring to FIG. 6, rollers R1, R2, D1, D2 and D3 have qualitative and quantitative differences in S-Factor as a function of engagement depth D. Both rollers R1 and R2, having a single layer solid rubber cover and roller D1 having a solid rubber outer layer over a thin compressible inner layer have S-Factors that increase monotonically with engagement D. Rollers R1, D2 and D3 have S-Factors that are substantially smaller in magnitude to rollers D1 and R2. Quantitatively, S factors averaged over a range of engagement D from 0 mm to 1 mm are tabulated in Table 1 along with the slope of the S-Factor for engagements D greater than 0.2 mm. It is to be understood that in some embodiments, the S factors can be averaged over a range of engagement D from 0.05 mm to 1 mm without significantly changing the result. It is important to note that there may be an upper engagement limit for some back-up roll constructions. For example, a compressible inner layer may be engaged to such an extent that the force begins to rise quickly with further engagement. When calculating the slope of the S-Factor it is understood that the range of engagement values used falls below an upper engagement limit wherein a compressible inner layer has been compressed beyond its design limit. The average S-Factor was calculated by averaging S-Factor data pairs ($S_i$, $D_i$) for all engagement values $D_i$ between 0 mm and 1 mm. The S-Factor slope was calculated by fitting a line to the S-Factor data pairs ($S_i$, $D_i$) for engagement values $D_i$ between 0.2 mm and 2 mm using the least squares method.

The S-Factor may be directly related to the uniformity of engagement D and contact force over the entire width in the cross-web direction of a Mayer rod coating system. Consistent nip pressure has been noted as a key element to obtaining uniform coating over the entire width of the web. A resilient back-up roll cover, having a low and consistent force response to changes in engagement D, can tolerate greater roller TIR or substrate thickness variation with minimal or no change to coating thickness or quality. In fact, a sufficiently resilient back-up roll cover can tolerate process upsets such as baggy web or splices with minor effect on coating quality. Such a resilient back-up roll cover can have an S-Factor, averaged over a range of engagement D from about 0 to 1.0 mm, or from 0.05 to 1.0 mm, that is less than 15 ($10^6 \cdot N/m^{5/2}$) and preferably less than 10 ($10^6 \cdot N/m^{5/2}$). Furthermore, a resilient back-up roll cover can have a slope in the S-Factor vs. engagement curve, for engagement values greater than 0.2 mm, that is less than 5000 ($10^6 \cdot N/m^{7/2}$), preferably less than 500 ($10^6 \cdot N/m^{7/2}$) and most preferably less than 50 ($10^6 \cdot N/m^{7/2}$).

To illustrate the effect of S-Factor on the uniformity of nip contact pressure over the length of the back-up roll, consider engaging a Mayer rod of 50.8 mm diameter and length 1.524 m into a back-up roll with the cover properties of roller D3 in Table 1 and length 1.524 m. Such a Mayer rod, supported at each of its two ends as shown in FIG. 3A, may bend as shown in FIG. 7A. Referring to FIG. 7A, the forces 70 at each end of the Mayer rod 20 engage the outer 14 and inner 12 layers of the back-up roll 10 mounted on the rigid shaft 11 by a variable engagement amount D(x) where x ranges over the entire cross-web length of the back-up roll L. The dashed line 72 represents the undeformed shape of the back-up roll cover. It may be appreciated that the relative height of the engagement D(x) is exaggerated in FIG. 7A to provide visual clarity.

Figure 7B:
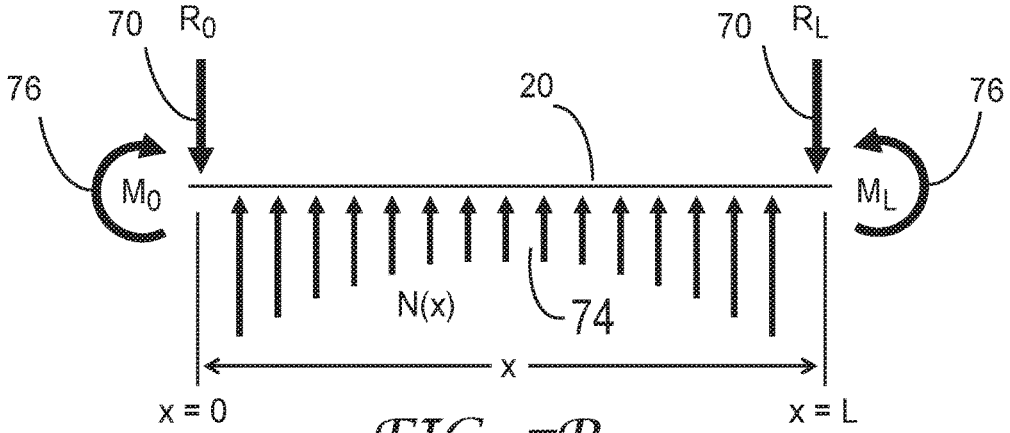
FIG. 7B illustrates a free body diagram of forces acting on the Mayer rod of FIG. 7A.

In FIG. 7B a free body diagram of the forces acting on the Mayer rod 20 are shown with reaction forces 70 designated $R_0$ and $R_L$, end moments or twisting forces 76 as $M_0$ and $M_L$ and a distributed contact force 74 as N(x). It should be noted that the end moments $M_0$ and $M_L$ may only be present for a Mayer rod having more than one support at each end of the rod as shown in FIG. 3B. As the engagement height D(x) varies over the length of the Mayer rod 20 it may be expected that the distributed contact force N(x) can vary accordingly.

Figure 7C:
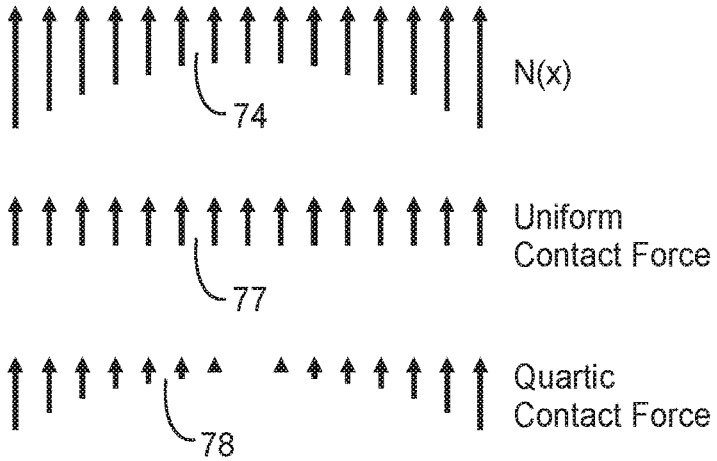
FIG. 7C illustrates a schematic diagram of approximating a distributed contact force by superposing a uniform contact force with a force having a quartic form.

In FIG. 7C, it can be shown that the distributed contact force N(x) 74 may be closely approximated by superposing a uniform contact force 77 with a force having a $4^{th}$ degree polynomial or quartic form 78 over the length of the Mayer rod. Justification for this approximation recognizes that Euler-Bernoulli beam theory ascribes a $4^{th}$ degree polynomial form to the deflection of a rod and because the rod deflection is closely related to contact force a similar function form is appropriate for N(x). Euler-Bernoulli beam theory and the deflection of uniform rods are well known to those skilled in the art with deflection formulae for various force distributions compiled in books such as Roark's Formulas for Stress and Strain. See, for example, Roark's Formulas for Stress and Strain, $7^{th}$ ed; Warren C. Young, Richard G. Budynas; McGraw-Hill 2002; ISBN 0-07-072542-X.

Making a further assumption that the quartic force component of FIG. 7C is very small relative to the uniform component, a maximum deflection $D_U$ at the center of a uniformly loaded and simply supported rod may be given by $$D_U = \frac{5 \cdot N_U}{6\pi \cdot E_M}\left(\frac{L_M}{A_M}\right)^4 \quad [4]$$

where $N_U$ is the magnitude of the distributed uniform force component and $E_M$, $A_M$ and $L_M$ are the elastic modulus, diameter and length of the Mayer rod respectively. Rearranging terms in Equation [4] and using the definition of S in Equation [3] an estimate of the maximum S value for a Mayer rod having a desirably uniform nip contact force may be derived.

$$S_U = \frac{6\pi \cdot E_M}{5 \cdot \sqrt{R_E}}\left(\frac{A_M}{L_M}\right)^4 \quad [5]$$

It is important to note that in Equation [5] the effective radius $R_E$ calculated using [2] is 19.4 mm or that of a 50.8 mm diameter Mayer rod engaging a 165-mm-diameter back-up roll D3 in Table 1. As noted previously, this application of the effective radius $R_E$ renders the deflection calculation of Equation [4], for a specific Mayer rod example, into a geometrically invariant form suitable for comparing to S-Factor.

For a steel Mayer rod of 1.524 m length a critical $S_U$=6.9 ($10^6 \cdot N/m^{5/2}$) is obtained as shown by the solid line S in FIG. 6. Equation [4] provides a good estimate for the maximum desirable slope factor $S_U$ for a Mayer rod coating system. Increasing the rod diameter $A_M$ or employing additional end supports for the rod as shown in FIG. 3B can increase $S_U$ and correspondingly the range of roller covers suitable for back-up rolls. It may be noted that these design changes may also increase the cost and complexity of building and operating the coating system. For example, a larger Mayer rod diameter may increase the hydrodynamic forces exerted by the coating solution on the rod that may in turn increase the deflection of the rod.

Figure 8:
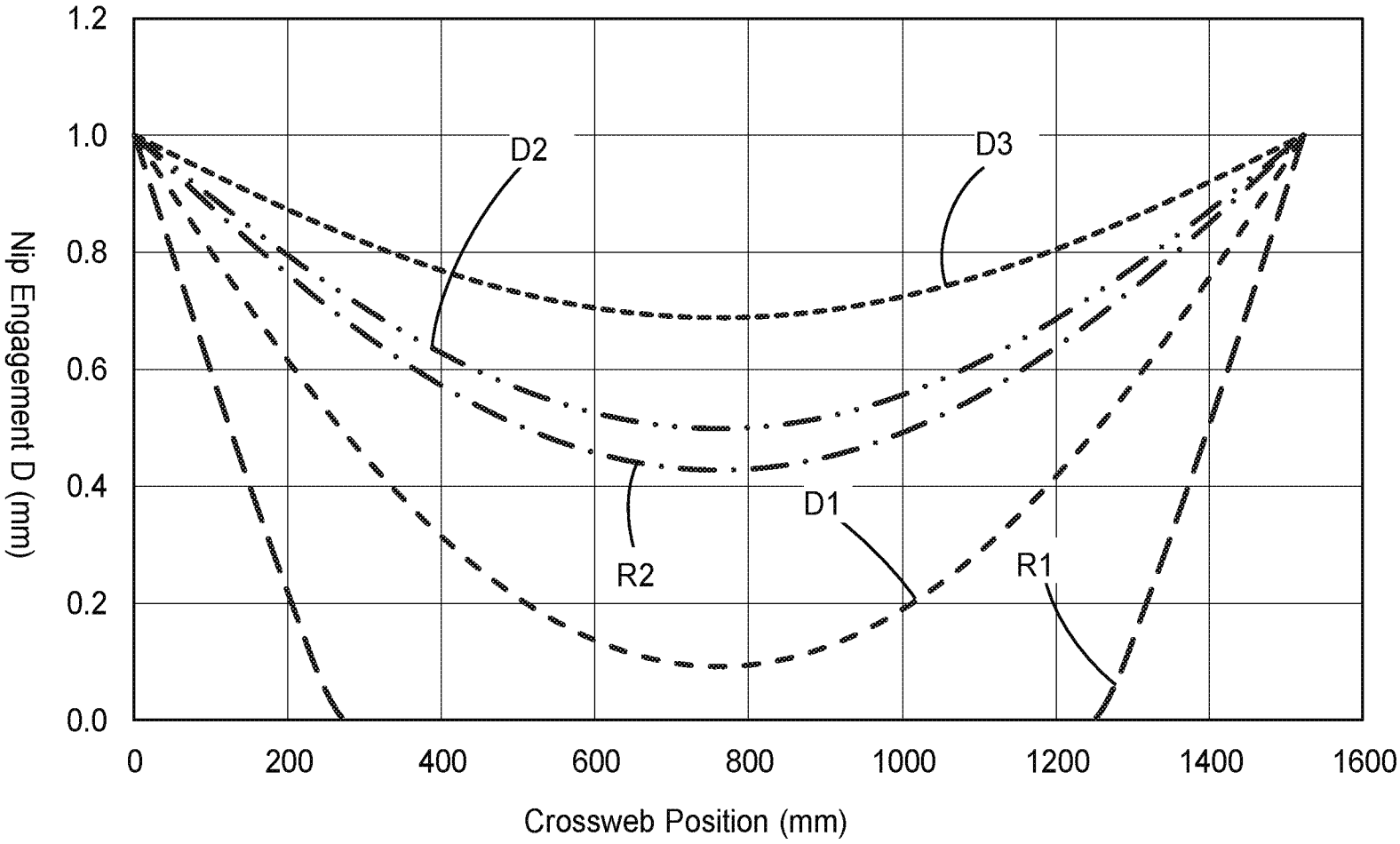
FIG. 8 illustrates plots of nip engagement depth versus cross-web position for various back-up rolls.

To determine the impact of S-Factor and S-Factor slope on cross-web rod engagement and coating pressure variation, it is convenient to dispense with the uniform force assumption used to derive Equations [4] and [5] and employ the well understood principle of superposition for the uniform and quartic force distributions shown in FIG. 7C. Calculated engagements of a Mayer rod with 50.8 mm diameter and 1.524 m length into back-up rolls R1, R2, D1, D2 and D3 are shown in FIG. 8. In all cases the ends of the rod were engaged to a depth of 1 mm into the respective back-up rolls listed in Table 2. A considerable variation of engagement depth D at the center of the Mayer rod may be noted for rolls R1 and D1 with back-up roll R1 failing to contact the back-up roll over most of the Mayer rod. By contrast, back-up rolls R2, D2 and D3 exhibit much lower variation in engagement depth cross-web.

Figure 9:
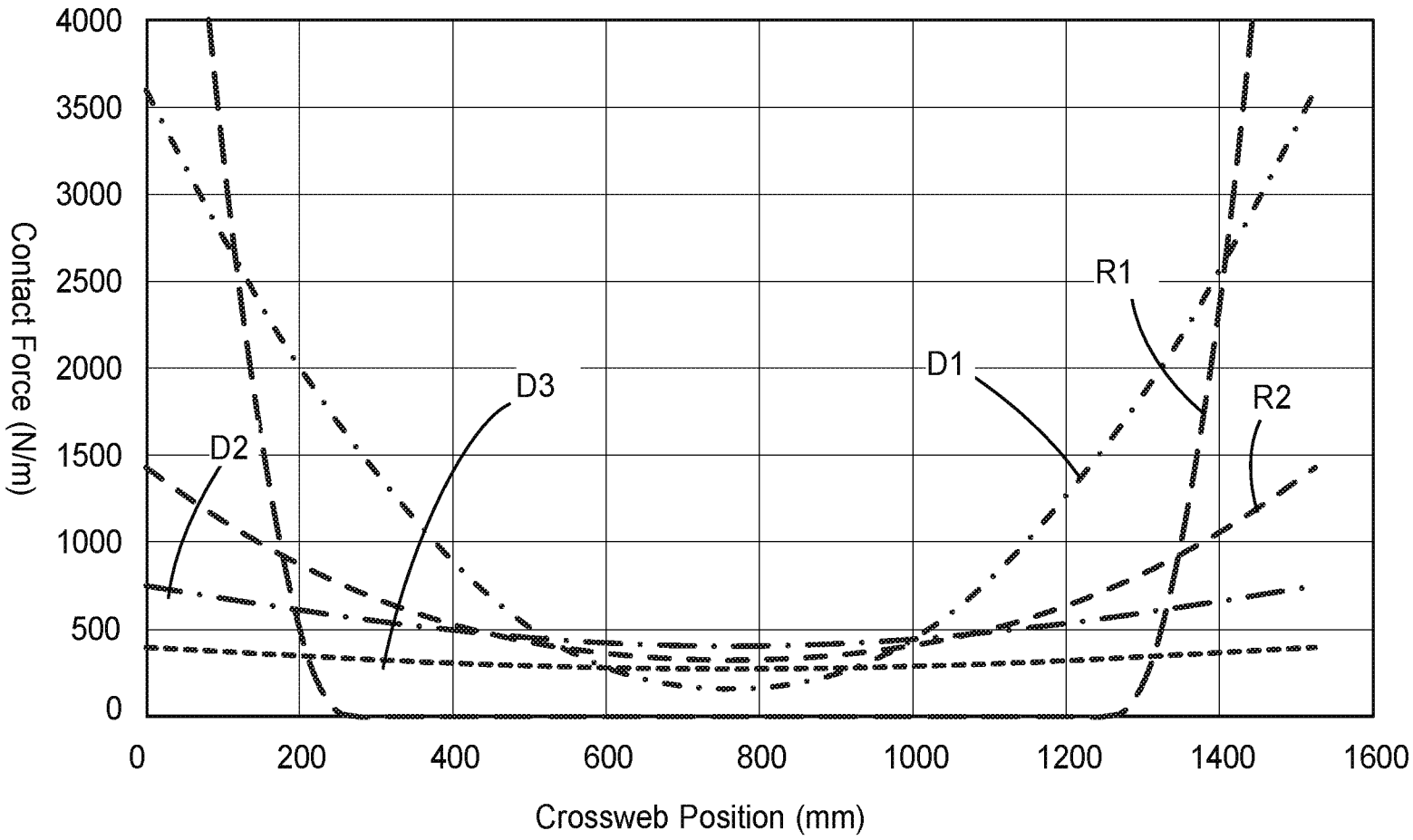
FIG. 9 illustrates plots of contact force versus cross-web position for various back-up rolls.
Figure 10:
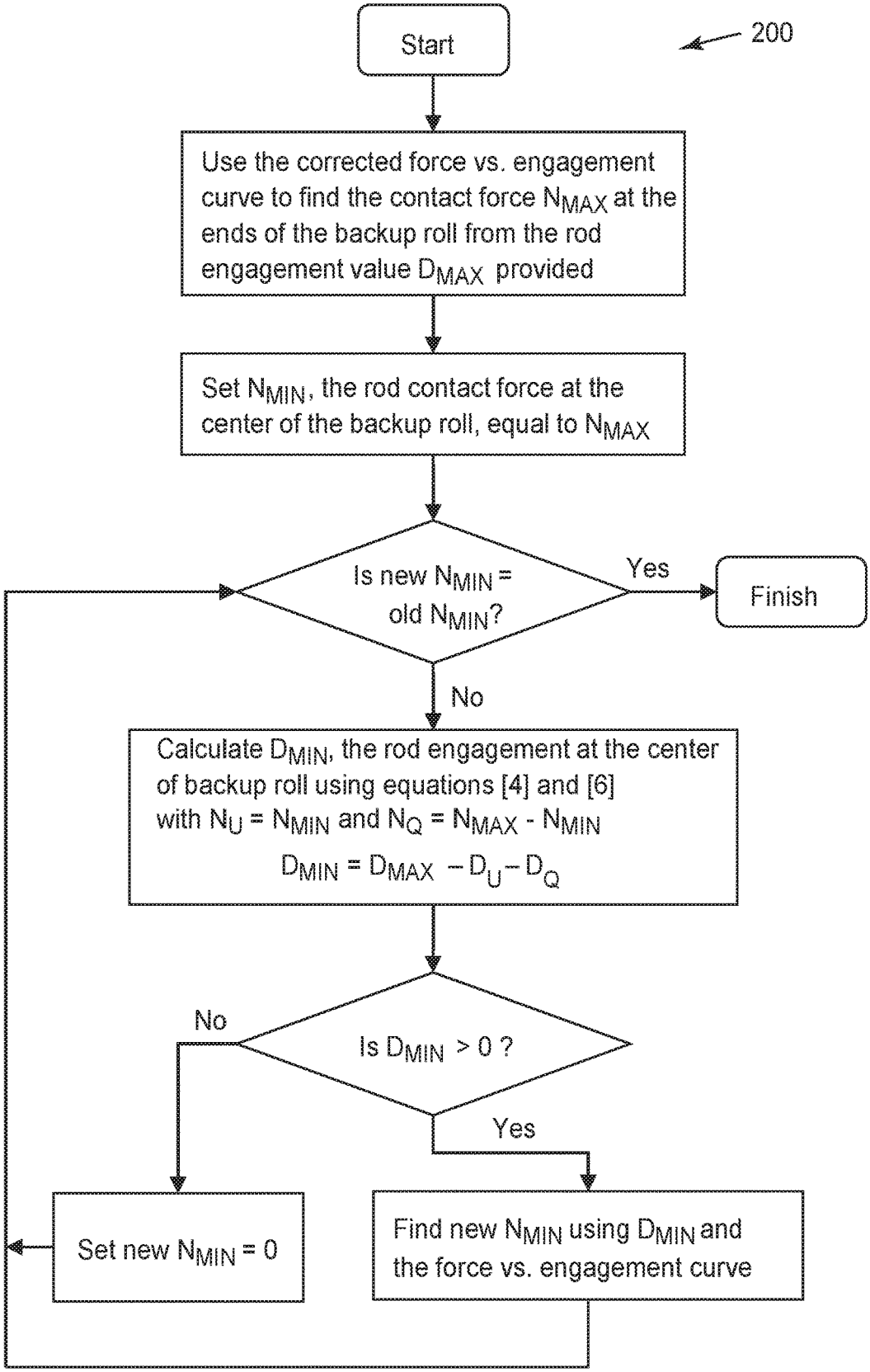
FIG. 10 illustrates a flow diagram for calculating Mayer rod engagement with a back-up roll in a cross-web direction.

Contact force between the Mayer rod and backup roll for the examples in FIG. 8 are shown in FIG. 9. Considerable cross-web variation in contact force are seen for back-up rolls R1 and D1 with R1 failing to contact most of the Mayer rod. By contrast R2, D2 and D3 show much lower variation in contact force. A flow chart 200 for carrying out cross-web rod engagement and contact force calculations is shown in FIG. 10, according to one embodiment. The Mayer rod engagement into both ends of the backup roll, $D_{MAX}$, is provided as an input to the calculations and represents the furthest penetration of the rod as shown in FIG. 7A. Using any suitable interpolation or curve fitting method, $D_{MAX}$ may be used to find a geometrically invariant maximum contact force from the corrected force vs. engagement data, for example C1 or C2 for back-up roll D2 in FIG. 5. Multiplication of this geometrically invariant maximum contact force by the square root of the effective radius, $R_E$, obtained from Equation [2] for the 50.8 mm Mayer rod and backup rolls in Table 1, results in the maximum contact force, $N_{MAX}$, between the rod and back-up rolls for the provided maximum engagement value $D_{MAX}$. The flow chart 200 in FIG. 10 outlines a procedure for finding the minimum engagement $D_{MIN}$ and corresponding minimum contact force $N_{MIN}$ at the center of the rod and backup roll. $D_U$ is obtained from Equation [4] for the uniform contact stress of FIG. 7C where $N_U$ has been set equal to $N_{MIN}$. A formula for the center deflection $D_Q$ of a rod with a quartic contact stress is provided in Equation [6] where $N_Q$ is equated to the difference between $N_{MAX}$ and $N_{MIN}$.

$$D_Q = \frac{73 \cdot N_Q}{420\pi \cdot E_M}\left(\frac{L_M}{A_M}\right)^4 \quad [6]$$

$E_M$, $A_M$ and $L_M$ are the Young's elastic modulus, diameter and length of the Mayer rod respectively. Executing the procedure 200 of FIG. 10 can generate $D_{MIN}$, $N_{MAX}$ and $N_{MIN}$ for a given $D_{MAX}$ input. Using the well understood principle of superposition of deflections from uniform and quartic contact stresses may be used to calculate Equation [7] the cross-web engagement, D(x), of the Mayer rod into the backup rolls with $D_U(x)$ given by Equation [8] and $D_Q(x)$ by Equation [9] with the following definitions for uniform contact stress $N_U = N_{MIN}$, quartic contact stress $$N_Q = N_{MAX} - N_{MIN} \text{ and } q = \frac{x}{L_M}.$$

$$D(x) = D_{MAX} - D_U(x) - D_Q(x) \quad [7]$$

$$D_U(x) = \frac{8N_U}{3\pi E}\left(\frac{L_M}{A_M}\right)^4 [q^4 - 2q^3 + q] \quad [8]$$

$$D_Q(x) = \frac{64N_Q}{\pi E}\left(\frac{L_M}{A_M}\right)^4\left[-\frac{q^8}{525} + \frac{4q^7}{525} - \frac{2q^5}{75} + \frac{q^4}{24} - \frac{3q^3}{100} + \frac{13q}{1400}\right] \quad [9]$$

With the cross-web rod engagement into the backup roll, D(x), a geometrically invariant cross-web contact force may be obtained, using any suitable interpolation or curve fitting method, from the corrected force vs. engagement data, for example C1 or C2 for back-up roll D2 in FIG. 5. Multiplication of the geometrically invariant cross-web contact force by the square root of the effective radius, $R_E$, obtained from Equation [2] for the 50.8 mm Mayer rod and backup rolls of Table 1, provides the predicted cross-web nip pressure between the rod and back-up rolls shown in FIG. 9.

TABLE 2

| | Nip Engagement D (mm) | | | Nip Pressure (N/m) | | | | S-Factor ($10^8 \cdot N/m^{5/2}$) | |
|---|---|---|---|---|---|---|---|---|---|
| Roller Name | Minimum | Average | Variation (%) | Maximum | Minimum | Average | Variation (%) | Average | Variation (%) |
| R1 - Medium Rubber | 0.000 | 0.183 | 545 | 8431 | 0 | 1128 | 748 | 35.4 | 162 |
| R2 - Soft rubber | 0.428 | 0.638 | 90 | 1428 | 320 | 674 | 164 | 7.5 | 68 |
| D1 - Dual layer thin | 0.092 | 0.421 | 215 | 3600 | 155 | 1327 | 260 | 20.8 | 70 |
| D2 - Dual layer medium | 0.508 | 0.689 | 72 | 748 | 404 | 533 | 84 | 5.8 | 7 |
| D3 - Dual layer thick | 0.689 | 0.804 | 39 | 396 | 274 | 320 | 38 | 2.9 | 1 |

Summary data from the computations of FIG. 8 and FIG. 9 are compiled in Table 2, which lists the cross-web engagement and nip pressure for a Mayer rod engaged 1 mm at its ends into back-up rolls labeled R1, R2, D1, D2 and D3. Mayer rod diameter is 50.8 mm and length 1.524 m. Variation of the nip engagement D and more importantly the nip pressure across the length of the nip contact is a key measure of back-up roll performance. It may be noted that the cross-web variation in nip engagement for back-up roll R2 is 26% greater than the variation for D2. However, the corresponding variation in nip pressure for R2 is 157% greater than the variation for D2. Average S-Factors and S-Factor variation were calculated for each nip engagement and contact force across the cross-web nip contact length using Equation [3] and are tabulated in Table 2. The average S-Factor for R2 was 25% greater than the average for D2. By contrast the S-Factor variation for R2, mainly governed by the degree of S-Factor slope, is more than 10 times the variation for D2. This calculation simulation for a production size Mayer rod coating system shows the critical role that S-Factor plays in achieving a uniform cross-web nip engagement and nip pressure. In particular, an overall small S-Factor value and an S-Factor slope that does not increase or even decreases with engagement depth D is a strong predictor of low variation in cross-web nip pressure.

In some embodiments, a desired back-up roll may have an S-Factor, averaged over a range of the nip engagement D from about 0 to about 1 mm or from about 0.05 mm to about 1 mm, less than about 15 ($10^6 \cdot N/m^{5/2}$), less than about 10 ($10^6 \cdot N/m^{5/2}$), or optionally less than about 5 ($10^6 \cdot N/m^{5/2}$). In some embodiments, an S-Factor slope, for a nip engagement D greater than about 0.2 mm but less than the engagement limit of the back-up roll, may be less than about 5000 ($10^6 \cdot N/m^{7/2}$), optionally less than about 500 ($10^6 \cdot N/m^{7/2}$), optionally less than about 50 ($10^6 \cdot N/m^{7/2}$).

Listing of Exemplary Embodiments

Exemplary embodiments are listed below. It is to be understood that any one of the embodiments 1-12, 13-32 and 33-37 can be combined.

Embodiment 1 is method of applying a coating onto a baggy web, the method comprising:

providing a back-up roll having a deformable inner layer with a surface thereof covered by a deformable outer layer, the inner layer being softer than the outer layer;

providing a Mayer rod in contact with the back-up roll;

disposing a flexible web between the back-up roll and the Mayer rod;

wrapping the flexible web around at least one of the back-up roll and the Mayer rod;

pressing the Mayer rod and the back-up roll against each other to form a nip therebetween, wherein the Mayer rod and the flexible web at a contacting area are impressed into the back-up roll with a machine-direction nip width W and a nip engagement depth D; and providing a coating material upstream of the nip to form a coating on a surface of the web downstream of the nip, wherein the back-up roll has an S-Factor, averaged over a range of the nip engagement D from about 0.05 mm to about 1 mm, optionally less than about 15 ($10^6 \cdot N/m^{5/2}$), or less than about 10 ($10^6 \cdot N/m$).

Embodiment 2 is the method of embodiment 1, further comprising adjusting at least one of the machine-direction nip width W and the nip engagement depth D to adjust a wet thickness of the coating.

Embodiment 3 is the method of embodiment 2, wherein the machine-direction nip width W or the nip engagement depth D is adjusted by adjusting the relative distance between the respective axes of the Mayer rod and the back-up roll.

Embodiment 4 is the method of any one of embodiments 1-3, wherein the relative distance the relative distance between the respective axes of the Mayer rod and the back-up roll is adjusted by moving, via a mounting and positioning mechanism, at least one of the Mayer rod and the back-up roll.

Embodiment 5 is the method of any one of embodiments 1-4, wherein the machine-direction nip width W is adjusted to be in a range from about 0.1 mm to about 50 mm.

Embodiment 6 is the method of any one of embodiments 1-5, wherein the nip engagement depth D is adjusted to be in a range from about 1.0 micrometer to about 10 mm.

Embodiment 7 is the method of any one of embodiments 1-6, wherein a wet thickness of the coating is adjusted to be within the range of about 5 to about 200 micrometers.

Embodiment 8 is the method of any one of embodiments 1-7, wherein the Mayer rod is pressed via a mechanical holder mounted on opposite ends of the Mayer rod, without touching a coating surface of the Mayer rod.

Embodiment 9 is the method of embodiment 8, wherein the mechanical holder includes one or more bearing elements.

Embodiment 10 is the method of any one of embodiments 1-9, further comprising rotating the Mayer rod at a different speed than the back-up roll, and the Mayer rod is rotated at a speed from about 1 m/min to about 50 m/min.

Embodiment 11 is the method of any one of embodiments 1-10, wherein the flexible web is a baggy web having surface non-flatness characteristics.

Embodiment 12 is the method of embodiment 11, wherein the coating has substantially no visible defects associated with the surface non-flatness characteristics of the baggy web.

Embodiment 13 is a coating apparatus comprising:

a back-up roll having a deformable inner layer with a surface thereof covered by a deformable outer layer, the inner layer being softer than the outer layer;

a Mayer rod in contact with the back-up roll;

a flexible web disposed between the back-up roll and the Mayer rod, and wrapping around at least one of the back-up roll and the Mayer rod; and one or more mechanical holders configured to press the Mayer rod and the back-up roll against each other to form a nip therebetween, wherein the Mayer rod and the flexible web at a contacting area are impressed into the back-up roll with a machine-direction nip width W and a nip engagement depth D.

Embodiment 14 is the coating apparatus of embodiment 13, wherein the mechanical holders are attached to at least one of the Mayer rod and the back-up roll and are capable of moving at least one of the Mayer rod and the back-up roll.

Embodiment 15 is the coating apparatus of embodiment 14, wherein the mechanical holders are connected to opposite ends of the Mayer rod without touching a coating surface of the Mayer rod.

Embodiment 16 is the coating apparatus of embodiment 14 or 15, wherein the mechanical holders further include one or more bearing elements at each end of the Mayer rod.

Embodiment 17 is the coating apparatus of embodiment 16, wherein the mechanical holders further include a stiffening beam to support the bearings at the ends of Mayer rod.

Embodiment 18 is the coating apparatus of embodiment 17, wherein the stiffening beam is positioned substantially parallel to the Mayer rod, extending between the opposite ends of the Mayer rod, without touching the coating surface of the Mayer rod.

Embodiment 19 is the coating apparatus of any one of embodiments 14-18, wherein the mechanical holders include a positioning mechanism to control the distance between the respective axes of the Mayer rod and the back-up roll to adjust at least one of the machine-direction nip width W and the nip engagement depth D.

Embodiment 20 is the coating apparatus of any one of embodiments 13-19, wherein the machine-direction nip width W is adjusted to be in a range from about 0.1 mm to about 50 mm.

Embodiment 21 is the coating apparatus of any one of embodiments 13-20, wherein the nip engagement depth D is adjusted to be in a range from about 1.0 micrometer to about 10 mm.

Embodiment 22 is the coating apparatus of any one of embodiments 13-21, wherein the back-up roll has a total indicated runout (TIR) no greater than about 100 micrometers, optionally no greater than about 50 micrometers.

Embodiment 23 is the coating apparatus of any one of embodiments 13-22, wherein the thickness ratio between the deformable inner layer and the deformable outer layer being about 3:1 or greater, optionally about 5:1 or greater, and the thickness of the outer layer of the back-up roll is less than 10 mm, optionally less than 5 mm.

Embodiment 24 is the coating apparatus of any one of embodiments 13-23, wherein the inner layer of the back-up roll has a hardness less than 20 Shore A, optionally less than 10 Shore A.

Embodiment 25 is the coating apparatus of any one of embodiments 13-23, wherein the inner layer of the back-up roll has a compressibility of less than about 45 psi at 25% deflection, optionally less than about 20 psi at 25% deflection.

Embodiment 26 is the coating apparatus of any one of embodiments 13-25, wherein the deformable outer layer of the back-up roll has a hardness greater than about 40 Shore A, optionally greater than about 50 Shore A.

Embodiment 27 is the coating apparatus of any one of embodiments 13-26, wherein the deformable outer layer includes one or more materials of an elastomer, a metal, a fabric, or a nonwoven.

Embodiment 28 is the coating apparatus of any one of embodiments 13-27, wherein the deformable inner layer includes one or more materials of a synthetic foam, an engraved, structured, 3D printed, or embossed elastomer, a fabric or nonwoven layer, a plurality of cavities filled with gas of a controlled pressure, or a soft rubber.

Embodiment 29 is the coating apparatus of any one of embodiments 13-28, wherein the flexible web includes a polymer web, a paper, a release liner, an adhesive coated web, a metal coated web, a flexible glass or ceramic web, a nonwoven, a fabric, or a combination thereof.

Embodiment 30 is the coating apparatus of any one of embodiments 13-29, wherein the back-up roll comprises a rigid central core, and the deformable inner layer is disposed on the rigid central core with a substantially uniform thickness about the periphery of the rigid central core.

Embodiment 31 is the coating apparatus of any one of embodiments 13-30, wherein the back-up roll has an S-Factor, averaged over a range of the nip engagement D from about 0.05 mm to about 1 mm, is less than about 15 ($10^6$·N/m), optionally less than about 10 ($10^6$·N/m).

Embodiment 32 is the coating apparatus of embodiment 31, wherein the slope in an S-Factor versus nip engagement depth D curve for the nip engagement D greater than about 0.2 mm is less than about 5000 ($10^6$·N/$m^{7/2}$), optionally less than about 500 ($10^6$·N/$m^{7/2}$), optionally less than about 50 ($10^6$·N/$m^{7/2}$).

Embodiment 33 is a method comprising:

providing a back-up roll and a Test Roller;

pressing the Test Roller and the back-up roll against each other through a range of engagement depth D;

measuring a contacting force F versus the nip engagement depth D curve for the Test Roller and the back-up roll by using a mechanical compression testing; and calculating a geometrically invariant S-Factor based on the measured curve by using the equation $$S = \frac{F}{D \cdot \sqrt{R_E}}, \text{ where } R_E = \frac{D_1 \cdot D_2}{2 \cdot (D_1 + D_2)},$$

and $D_1$ and $D_2$ representing the respective diameters of the Test Roller and the back-up roll.

Embodiment 34 is the method of embodiment 33, further comprising determining whether the back-up roll is applicable for applying a substantially uniform coating onto a baggy web.

Embodiment 35 is the method of embodiment 34, wherein when the back-up roll has an S-Factor, averaged over a range of the nip engagement D from about 0.05 mm to about 1 mm, is less than about 15 ($10^6$·N/$m^{5/2}$), optionally less than about 10 ($10^6$·N/$m^{5/2}$), the back-up roll is applicable.

Embodiment 36 is the method of embodiment 34, wherein the slope in an S-Factor versus nip engagement depth D curve for the nip engagement D greater than about 0.2 mm is less than about 5000 ($10^6$·N/$m^{7/2}$), optionally less than about 500 ($10^6$·N/$m^{7/2}$), optionally less than about 50 ($10^6$·N/$m^{7/2}$).

Embodiment 37 is the method of any one of embodiments 33-36, wherein the Test Roller is a Mayer rod.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term "about."

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. A method of applying a coating onto a baggy web, the method comprising:

contacting a Mayer rod with a back-up roll, wherein the back-up roll includes a deformable inner layer with a surface thereof covered by a deformable outer layer, the inner layer being softer than the outer layer, wherein the deformable inner layer of the back-up roll has a hardness less than 20 Shore A, and the deformable outer layer of the back-up roll has a hardness greater than about 40 Shore A;

disposing a flexible web between the back-up roll and the Mayer rod;

wrapping the flexible web around at least one of the back-up roll and the Mayer rod;

pressing the Mayer rod and the back-up roll against each other to form a nip therebetween, wherein the Mayer rod and the flexible web at a contacting area are impressed into the back-up roll with a machine-direction nip width W and a nip engagement depth D; and providing a coating material upstream of the nip to form a coating on a surface of the web downstream of the nip, wherein the back-up roll has a S-Factor, averaged over a range of the nip engagement D from about 0.05 mm to about 1 mm, being less than about 10 ($10^6$·N/$m^{5/2}$), where the S-Factor is defined by an equation $$S = \frac{F}{D \cdot \sqrt{R_E}},$$

where S represents the S-Factor, D represents the nip engagement depth, F represents an applied force, and RE represents an effective radius of the Mayer rod and the back-up roll, and wherein the Mayer rod comprises one or more predefined openings that remain open when the Mayer rod and the back-up roll are pressed against each other to allow the coating material to pass through.

2. The method of claim 1, further comprising adjusting at least one of the machine-direction nip width W and the nip engagement depth D to adjust a wet thickness of the coating.

3. The method of claim 2, wherein the machine-direction nip width W or the nip engagement depth D is adjusted by adjusting the relative distance between the respective axes of the Mayer rod and the back-up roll.

4. The method of claim 3, wherein the relative distance is adjusted by moving, via a mounting and positioning mechanism, at least one of the Mayer rod and the back-up roll.

5. The method of claim 2, wherein a wet thickness of the coating is adjusted to be within the range of about 5 to about 200 micrometers.

6. The method of claim 1, wherein the Mayer rod is pressed via a mechanical holder mounted on opposite ends of the Mayer rod, without touching a coating surface of the Mayer rod.

7. The method of claim 6, wherein the mechanical holder includes one or more bearing elements at the opposite ends of the Mayer rod.

8. The method of claim 1, further comprising rotating the Mayer rod at a speed from about 1 m/min to about 50 m/min.

9. The method of claim 1, wherein the flexible web is a baggy web having surface non-flatness characteristics including at least one of a lane, a strip, a bump, or a ripple.

10. A coating apparatus comprising:

a back-up roll having a deformable inner layer with a surface thereof covered by a deformable outer layer, the inner layer being softer than the outer layer, wherein the deformable inner layer of the back-up roll has a hardness less than 20 Shore A, and the deformable outer layer of the back-up roll has a hardness greater than about 40 Shore A;

a Mayer rod in contact with the back-up roll;

a flexible web disposed between the back-up roll and the Mayer rod, and wrapping around at least one of the back-up roll and the Mayer rod; and one or more mechanical holders configured to press the Mayer rod and the back-up roll against each other to form a nip therebetween, wherein the Mayer rod and the flexible web at a contacting area are impressed into the back-up roll with a machine-direction nip width W and a nip engagement depth D, and wherein the back-up roll has a S-Factor, averaged over a range of the nip engagement D from about 0.05 mm to about 1 mm, being less than about 10 ($10^6 \cdot N/m^{5/2}$), where the S-Factor is defined by an equation $$S = \frac{F}{D \cdot \sqrt{R_E}},$$

where S represents the S-Factor, D represents the nip engagement depth, F represents an applied force, and RE represents an effective radius of the Mayer rod and the back-up roll, and wherein the Mayer rod comprises one or more predefined openings that remain open when the Mayer rod and the back-up roll are pressed against each other to allow the coating material to pass through.

11. The coating apparatus of claim 10, wherein the one or more mechanical holders are attached to at least one of the Mayer rod and the back-up roll and are capable of moving at least one of the Mayer rod and the back-up roll.

12. The coating apparatus of claim 10, wherein the one or more mechanical holders are connected to opposite ends of the Mayer rod without touching a coating surface of the Mayer rod.

13. The coating apparatus of claim 12, wherein the one or more mechanical holders include one or more bearing elements at each end of the Mayer rod.

14. The coating apparatus of claim 13, wherein the one or more mechanical holders further include a stiffening beam to support the bearings at the ends of Mayer rod.

15. The coating apparatus of claim 10, wherein the one or more mechanical holders include a positioning mechanism to control the distance between the respective axes of the Mayer rod and the back-up roll to adjust at least one of the machine-direction nip width W and the nip engagement depth D.

16. The coating apparatus of claim 10, wherein the deformable inner layer of the back-up roll has a hardness less than 10 Shore A.

17. The coating apparatus of claim 10, wherein the inner layer of the back-up roll has a compressibility of less than about 45 psi at 25% deflection.

18. The coating apparatus of claim 10, wherein the deformable outer layer of the back-up roll has a hardness greater than about 50 Shore A.

19. The coating apparatus of claim 10, wherein the deformable outer layer includes one or more materials of an elastomer, a metal, a fabric, or a nonwoven.

20. The coating apparatus of claim 10, wherein the deformable inner layer includes one or more materials of a synthetic foam, an elastomer, a fabric or nonwoven layer, or a soft rubber.

* * * * *